US005182451A

United States Patent [19]

Schwartz et al.

[11] Patent Number: 5,182,451

[45] Date of Patent: Jan. 26, 1993

[54] METHOD OF OPERATING AN ION TRAP MASS SPECTROMETER IN A HIGH RESOLUTION MODE

[75] Inventors: Jae C. Schwartz; John E. P. Syka; John N. Louris, all of Santa Clara County, Calif.

[73] Assignee: Finnigan Corporation, San Jose, Calif.

[21] Appl. No.: 849,970

[22] Filed: Mar. 12, 1992

Related U.S. Application Data

[63] Continuation-in-part of Ser. No. 693,808, Apr. 30, 1991, abandoned.

[51] Int. Cl.[5] ..... H01J 49/42

[52] U.S. Cl. ..... 250/282; 250/290; 250/292; 250/283

[58] Field of Search ..... 250/282, 281, 290, 291, 250/292, 293, 286

[56] References Cited

U.S. PATENT DOCUMENTS 4,540,884 9/1985 Stafford et al. ..... 250/282
4,686,367 8/1987 Louris et al. ..... 250/290
4,736,101 4/1988 Syka et al. ..... 250/292
4,749,860 6/1988 Kelley et al. ..... 250/282
4,771,172 9/1988 Weber-Grabau ..... 250/282

*Primary Examiner*—Jack I. Berman
*Assistant Examiner*—Jim Beyer
*Attorney, Agent, or Firm*—Flehr, Hobach, Test, Albritton & Herbert

[57] ABSTRACT

A method of mass analyzing a sample including the steps of defining a trap volume with a three-dimensional quadrupole field for trapping ions within a predetermined range of mass-to-charge ratio, forming or injecting ions within the trap volume such that those within the predetermined mass-to-charge ratio range are trapped within the trap volume, applying a supplementary AC field superimposed on the three-dimensional quadrupole field to form combined fields, scanning the combined fields to eject ions of consecutive mass-to-charge ratio from the trap volume for detection characterized in that the supplementary field has an amplitude just sufficient to eject the ions and that the supplementary field has a beta value below 0.891 and that the combined fields are scanned at a rate so that a length of time corresponding to 200 cycles or more of the supplementary AC field passes per consecutive thomson.

14 Claims, 20 Drawing Sheets

FIG.−2

METHOD OF OPERATING AN ION TRAP MASS SPECTROMETER IN A HIGH RESOLUTION MODE

RELATED APPLICATION

This application is a continuation-in-part of copending application Ser. No. 07/693,808 filed Apr. 30, 1991, abandoned.

BRIEF DESCRIPTION OF THE INVENTION

This invention relates to a method of operating an ion trap mass spectrometer in a wide mass range high resolution mode.

BACKGROUND OF THE INVENTION

Ion trap mass spectrometers, or quadrupole ion stores, have been known for many years and described by several authors. They are devices in which ions are formed and contained within a physical structure by means of electrostatic fields such as r.f., DC and a combination thereof. In general, a quadrupole electric field provides an ion storage region by the use of a hyperbolic electrode structure or a spherical electrode structure which provides an equivalent quadrupole trapping field.

The storage of ions in an ion trap is achieved by operating trap electrodes with values of r.f. voltage V and associated frequency f, DC voltage U, and device size $r_0$ and $z_0$ such that ions having mass-to-charge ratios within a finite range are stably trapped inside the device. The aforementioned parameters are sometimes referred to as trapping parameters and from these one can determine the range of mass-to-charge ratios that will permit stable trajectories and the trapping of ions. For stably trapped ions the component of ion motion along the axis of the trap may be described as an oscillation containing innumerable frequency components, the first component (or secular frequency) being the most important and of the lowest frequency, and each higher frequency component contributing less than its predecessor. For a given set of trapping parameters, trapped ions of a particular mass-to-charge ratio will oscillate with a distinct secular frequency that can be determined from the trapping parameters by calculation. In an early method for the detection of trapped ions, these secular frequencies were determined by a frequency-tuned circuit which coupled to the oscillating motion of the ions within the trap and allowed the determination of the mass-to-charge ratio of the trapped ions (from the known relationship between the trapping parameters, the frequency, and the m/z) and also the relative ion abundances (from the intensity of the signal).

Although quadrupole ion traps were first used as mass spectrometers over thirty years ago, the devices had not gained wide use until recently because the early methods of mass analysis were insufficient, difficult to implement, and yielded poor mass resolution and limited mass range. A new method of ion trap operation, the "mass-selective instability mode" (described in U.S. Pat. No. 4,540,884), provided the first practical method of mass analysis with an ion trap and resulted in the wide acceptance and general use of ion trap mass spectrometers for routine chemical analysis. In this method of operation, which was used in the first commercially-available ion trap mass spectrometers, a mass spectrum is recorded by scanning the r.f. voltage applied to the ring electrode whereby ions of successively increasing m/z are caused to adopt unstable trajectories and to exit the ion trap where they are detected by an externally mounted detector. The presence of a light buffer gas such as helium at a pressure of approximately $1\times10^3$ Torr was also shown to enhance sensitivity and resolution in this mode of operation.

Although the mass-selective instability mode of operation was very successful, a newer method of operation, the "mass-selective instability mode with resonance ejection" (described in U.S. Pat. No. 4,736,101) proved to have certain advantages such as the ability to record mass spectra containing a greater range in abundances of the trapped ions. In this method of operation, a supplementary field is applied across the end cap electrodes and the magnitude of the r.f. field is scanned to bring ions of successively increasing m/z into resonance with the supplementary field whereby they are ejected and detected to provide a mass spectrum. Commercially-produced ion trap mass spectrometers based on this mode of operation have recently become available, and these instruments have been successfully applied to an even wider variety of problems in chemical analysis than their predecessors.

The capabilities of quadrupole ion traps have continued to expand since the development of the mass-selective instability modes of operation described above. The versatility of these relatively simple mass spectrometers has been demonstrated by their high sensitivity in both electron and chemical ionization and their ability to serve as gas-phase ion/molecule reactors. The successful introduction of externally produced ions into these devices has even allowed the study of biomolecules using such techniques as laser desorption, cesium ion description, and electrospray ionization. The ion storage ability of the quadrupole ion trap makes possible tandem mass spectrometry (MS/MS) (U.S. Pat. No. 4,736,101) involving many stages of mass analysis with efficient dissociation of ions. Even parent MS/MS scans have been reported. The usable mass range of these mass spectrometers has been extended to 45,000 daltons (for singly charged ions) and beyond.

Despite these capabilities, a limitation of the ion trap mass spectrometer as compared to other types of instruments, such as sector (including three- and four-sector) instruments or Fourier transform-ion cyclotron resonance instruments, is the constraint of always operating at a relatively low resolution.

OBJECTS AND SUMMARY OF THE INVENTION

It is an object of this invention to provide a method of operating an ion trap mass spectrometer as a high resolution mass spectrometer.

It is another object of the invention to provide a method of operating an ion trap mass spectrometer in a high resolution mass-selective instability mode with resonance ejection.

It is another object of the invention to provide a method of operating an ion trap mass spectrometer in the high resolution mass-selective instability mode in which a three-dimensional trapping field has superimposed a supplementary AC field to form a combined field and the combined field is scanned at a slow rate.

It is another object of the invention to provide a method of operating an ion trap mass spectrometer in the mass-selective instability mode with resonance ejection in which the supplementary AC field is chosen appropriately to maximize the resolution.

It is another object of the invention to provide a method of determining charge states of ions stored in a quadrupole ion trap mass spectrometer in which the high resolution mass-selective instability mode with resonance ejection is used.

The foregoing and other objects of this invention are achieved by a method of mass analyzing a sample including the steps of defining a trap volume with a three-dimensional substantially quadrupole field for trapping ions within a predetermined range of mass-to-charge ratios, forming or injecting ions within said trap volume such that those within said predetermined mass-to-charge ratio range are trapped within said trap volume, applying a supplementary AC field superimposed on said three-dimensional quadrupole field to form combined fields, scanning said combined fields to eject ions of consecutive mass-to-charge ratio from said trap volume for detection characterized in that said supplementary field has an amplitude just sufficient to eject said ions and that said supplementary field has a beta value below 0.891 and that said combined fields are scanned at a rate so that a length of time corresponding to 200 cycles or more of the supplementary r.f. field passes per consecutive mass-to-charge unit.

BRIEF DESCRIPTION OF THE DRAWINGS

Operation of an ion trap to achieve the above and other objects of the invention will be clearly understood when the following description is read in conjunction with the accompanying drawings of which.

DESCRIPTION OF PREFERRED EMBODIMENT

Figure 1:
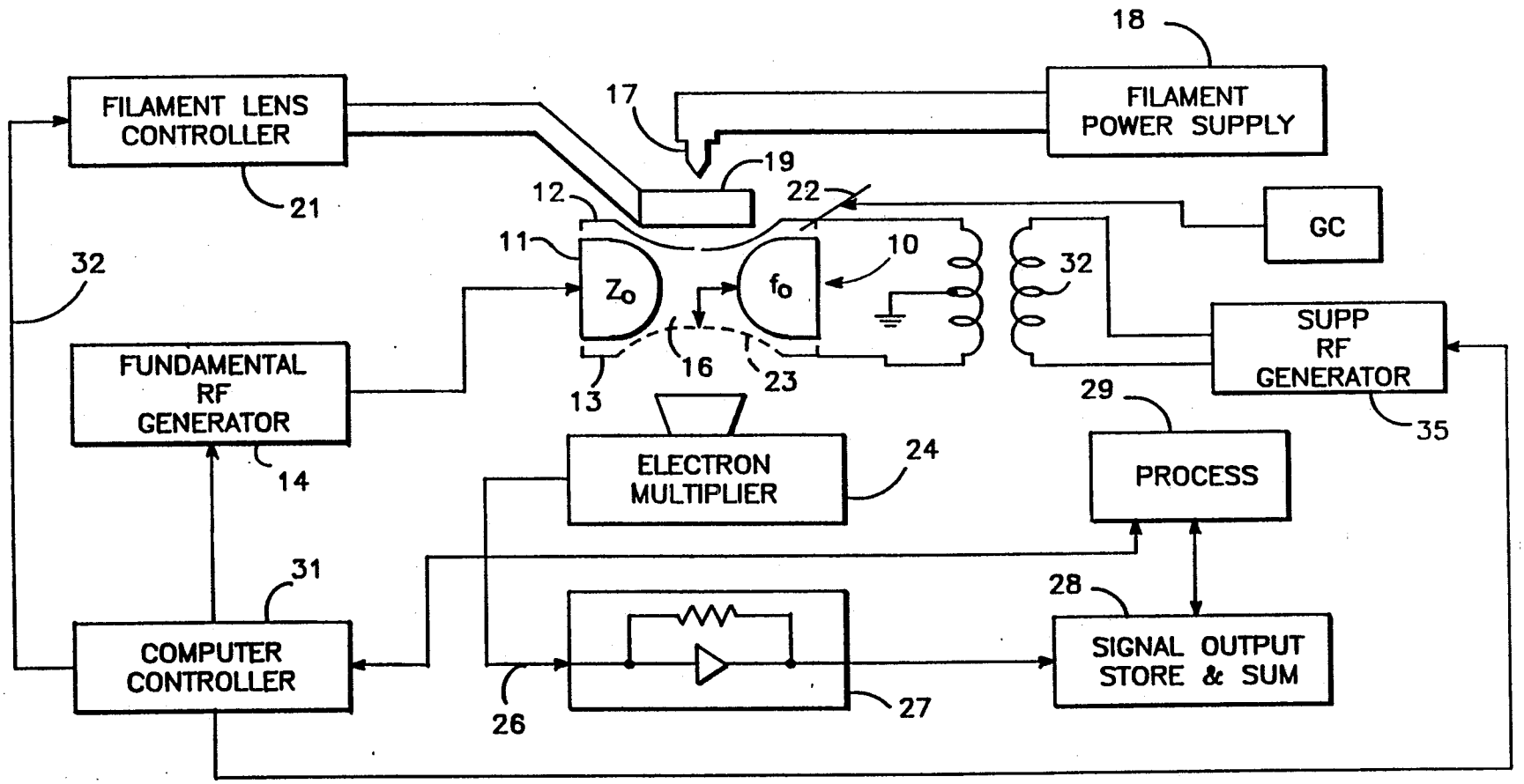
FIG. 1 is a simplified schematic of a quadrupole ion trap mass spectrometer along with a block diagram of associated electrical circuits for operating the mass spectrometer in accordance with the invention.

There is shown in FIG. 1 at 10 a three-dimensional ion trap which includes a ring electrode 11 and two end caps 12 and 13 facing each other. A radio frequency voltage generator 14 is connected to the ring electrode 11 to supply an r.f. voltage V sin $\omega t$ (the fundamental voltage) between the end caps and the ring electrode which provides a substantially quadrupole field for trapping ions within the ion storage region or volume 16. The field required for trapping is formed by coupling the r.f. voltage between the ring electrode 11 and the two end-cap electrodes 12 and 13 which are common mode grounded through coupling transformer 32 as shown. A supplementary r.f. generator 35 is coupled to the end caps 22, 23 to supply a radio frequency voltage $V_2$ sin $\omega_2 t$ between the end caps. A filament 17 which is fed by a filament power supply 18 is disposed which can provide an ionizing electron beam for ionizing the sample molecules introduced into the ion storage region 16. A cylindrical gate lens 19 is powered by a filament lens controller 21. This lens gates the electron beam on and off as desired. End cap 12 includes an aperture through which the electron beam projects.

Rather than forming the ions by ionizing sample within the trap region 16 with an electron beam, ions can be formed externally of the trap and injected into the trap by a mechanism similar to that used to inject electrons. In FIG. 1, therefore, the external source of ions would replace the filament 17 and ions, instead of electrons, are gated into the trap volume 16 by the gate lens 19. The appropriate potential and polarity are used on gate lens 19 in order to focus ions through the aperture in end-cap 12 and into the trap. The external ionization source can employ, for example, electron ionization, chemical ionization, cesium ion desorption, laser desorption, electrospray, thermospray ionization, particle beam, and any other type of ion source. In our apparatus, the external ion source region is differentially pumped with respect to the trapping region.

The opposite end cap 13 is perforated 23 to allow unstable ions in the fields of the ion trap to exit and be detected by an electron multiplier 24 which generates an ion signal on line 26. An electrometer 27 converts the signal on line 26 from current to voltage. The signal is summed and stored by the unit 28 and processed in unit 29.

Controller 31 is connected to the fundamental r.f. generator 14 to allow the magnitude and/or frequency of the fundamental r.f. voltage to be scanned to bring successive ions towards resonance with the supplementary field applied across the end caps for providing mass selection. The controller 31 is also connected to the supplementary r.f. generator 35 to allow the magnitude and/or frequency of the supplementary r.f. voltage to be controlled. The controller on line 32 is connected to the filament lens controller 21 to gate into the trap the ionizing electron beam or an externally formed ion beam only at time periods other than the scanning interval. Mechanical details of ion traps have been shown, for example, U.S. Pat. No. 2,939,952 and more recently in U.S. Pat. No. 4,540,884 assigned to the present assignee.

Figure 2:
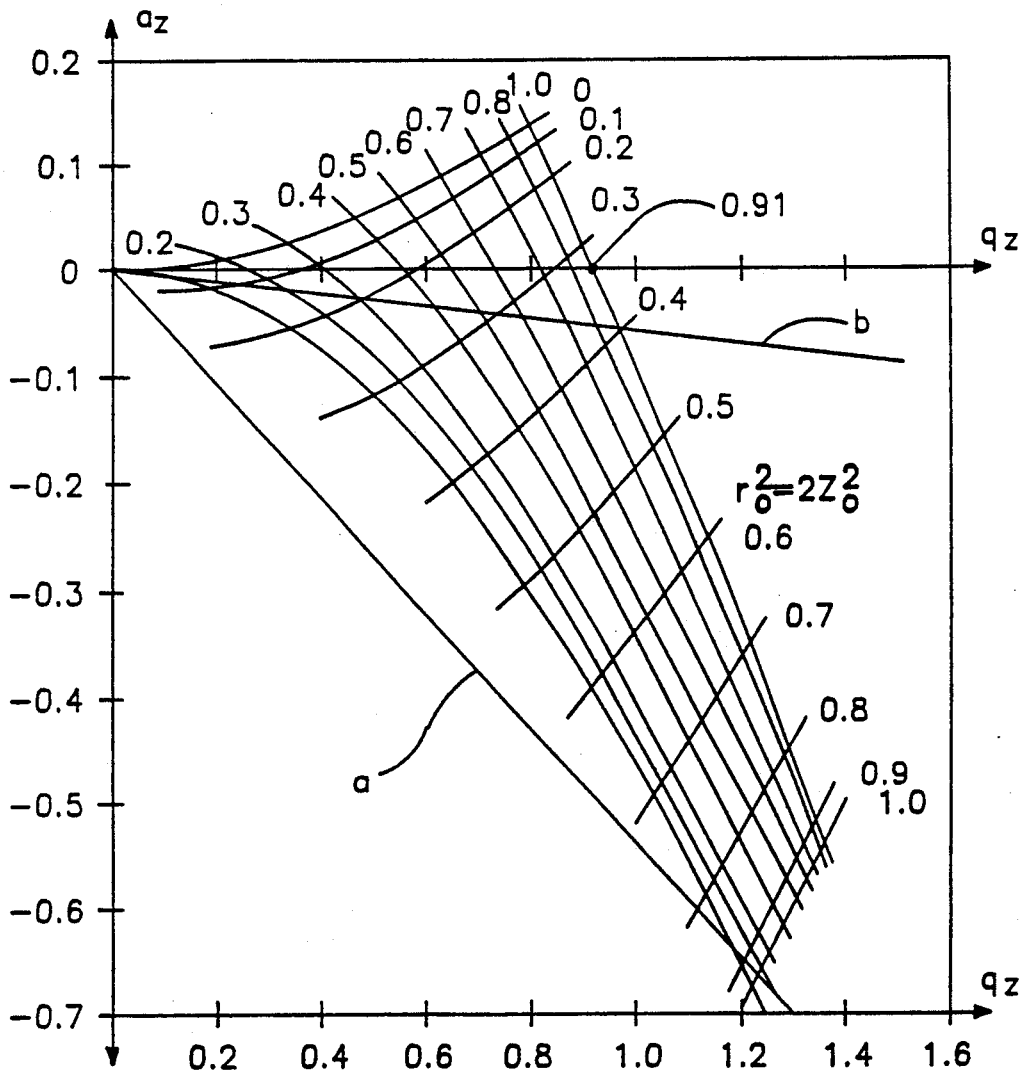
FIG. 2 is the stability envelope for the ion trap of the mass spectrometer shown in FIG. 1.

The symmetric fields in the ion trap 10 lead to the well known stability diagram shown in FIG. 2. The parameters a and q in FIG. 2 are defined as $$a=-8eU/mr_0^2\omega^2$$

$$q=4ev/mr_0^2\omega^2$$

where e and m are respectively charge on and mass of a charged particle. For any particular ion, the values of a and q must be within the stability envelope if it is to be trapped within the quadrupole fields of the ion trap device. This figure also shows iso-beta lines ($\beta$) where $\beta=2\omega_0/\omega$ and $\omega_0$ is the secular frequency of the ion's motion within the trapping field. In the mass-selective instability mode with resonance ejection, one typically scans the r.f. voltage, V, applied to the ring electrode while a supplementary voltage, $V_2$, of particular frequency described by $\beta_{z\text{-}eject}$ and amplitude is applied between the end-cap electrodes. The ions are thereby sequentially brought toward resonance, oscillate along the axis of the trap with increased amplitude, and are ejected through perforations in an end-cap electrode to be detected by an external ion detector. This sequential ejection of ions according to their m/z value allows the determination of the m/z of the ions.

However, there are many other ways to apply and scan the applied fields which can equivalently produce mass analysis using mass-selective instability with resonance ejection. For example, the supplementary voltage, $V_2$, might be applied to only one of the end caps. Alternatively, the r.f. voltage V, may be applied to the two end caps while the supplementary voltage, $V_2$, is applied to the ring electrode. Through the use of a DC voltage component applied to the ring electrode, the ion ejection may be caused to occur at some point in the stability diagram other than along the $a_z=0$ axis. Thus, the r.f. voltage might remain constant during the mass analysis while the DC voltage is increased (or decreased) to successively bring ions toward resonance. Lastly, the frequency of the supplementary voltage might be scanned to successively bring ions into resonance. More elaborate schemes are possible while all have the characteristic of successively bringing ions of increasing (or decreasing) m/z towards a resonance point in order to cause ejection, ion detection, and the determination of the ions' m/z values. The method of increasing resolution in an ion trap mass spectrometer described herein applies to all scans referred to as the combination of mass-selective instability with resonance ejection.

Traditionally, the resolution of a mass spectrometer is defined by the equation $R=m/\Delta m$, where m is the mass of interest and $\Delta$m is the peak width in mass units at some specified peak height. In general, resolution gives a measure of how well an instrument can distinguish one mass from a mass close to it. Sector (magnetic and electric) based mass spectrometers have the quality of constant resolution throughout their mass range and hence the definition. Unlike sector based mass spectrometers, quadrupole-field based mass spectrometers, such as linear quadrupole mass analyzers and quadrupole ion traps, produce constant peak width ($\Delta$(m/z)) throughout their mass range and thus show resolution that increases with m/z value. Consequently, in the discussion that follows, both terms, "peak width" and "resolution" are used, but the distinction and the properties of the instrument with respect to both, should be recognized.

All mass spectrometers rely on ion acceleration induced by electric or magnetic fields (or both) so that differences in ion trajectories may be exploited to determine their masses. Since the amount of acceleration induced by either an electric or a magnetic field is a function of mass-to-charge ratio (and not simplify of mass alone), all mass spectrometers directly measure mass-to-charge ratio and do not directly measure mass. A more correct definition of resolution is $R=(m/z)/(\Delta(m/z))$.

The common use of m/$\Delta$m for the definition of a mass spectrometer's resolution is just one example of mass spectrometer's long habit of writing and speaking of the measured quantity, m/z, as if it were a mass. Even the accepted name of the instrument, the mass spectrometer, uses this imprecise terminology. Throughout the early development of the field, the common methods of ionization produced only singly charged ions, with multiply charged ions being only infrequently encountered. Thus it came to be understood that all peaks in a spectrum were from singly charged ions, except for an occasional anomalous peak from doubly or multiply charged ions. Mass spectra are usually presented as a plot of abundance vs m/z, but since there has been no unit for mass-to-charge ratio, the m/z value of a particular ion is often given in daltons (especially in oral presentations). Indeed, many mass spectrometrists argue that the dimensionality of m/z is in fact mass, with m being given in daltons and z being a dimensionless number of charges. Others argue that the dimensionality of m/z is in fact mass/charge.

Unfortunately, the use of the same term, dalton, for the measured quantity (m/z) and for the desired quantity (mass) can lead to confusion when discussing spectra with multiply charged ions or when discussing the instrumentation of mass spectrometry. To eliminate this confusion, Cooks and Rockwood have recently proposed the adoption of a new unit, the thomson (Rapid Communications in Mass Spectrometry, v.5, no.2, p.93, 1991; A. Rockwood, Proceedings of the 39th ASMS Conference on Mass Spectrometry and Allied Topics, May 19–24, 1991, Nashville, Tenn., p.1770–1771). The thomson is defined as $1.0364272\times10^{-8}$ kilograms/coulomb. This unit is chosen so that the axis of a mass spectrum may still be labeled as "m/z", and the term and entrenched symbol "m/z" may still be used for other purposes, but the quantity will be referred to as "thomsons" rather than "m/z units" (which may still be used) or "daltons" (which should be discouraged). Thus, for example, in a mass spectrum of nitrogen, a peak is present at 28 thomsons for $N_2^+$ and at 14 thomsons for $N_2^{++}$. Even though this unit is not yet widely accepted, we will use it here because of its precise meaning, particularly when discussing the operation of the instrumentation of mass spectrometry.

The quadrupole ion trap operated in the mass-selective instability mode (with or without resonance ejection) has thus far only been able to achieve so called "unit" or near unit resolution (as with the conventional linear quadrupole mass analyzer). This term is somewhat confusing given the definition of resolution; it indicates that peak width is one thomson wide (at the baseline of intensity or 0.5 thomsons at full width half maximum, FWHM) throughout the normal mass range (thomson range) of the instrument. This resolution is sufficient to separate singly charged ions of consecutive masses that are nominally one dalton apart. Although linear quadrupole analyzers are typically operated in such a manner as to give constant peak width (in thomsons), operation at too high a resolution reduces the signal to an unusably low level.

Although many applications of mass spectrometry do not require greater than unit resolution, those applications that do require greater resolution have previously necessitated the use of complex and expensive sector or ion cyclotron resonance mass spectrometers. Formerly, the most important application of high-resolution mass spectrometry was the separation and identification of ions of the same nominal mass (to within 0.5 u) but of very slightly different mass due to differences in the elemental composition. (Such pairs of ions are called isobars).

Recently, the separation and mass-analysis of multiply-charged ions has become important because of the invention of the electrospray ion source. This device allows the coupling of a liquid-chromatography apparatus and a mass spectrometer, but typically creates ions with more than one charge, in contrast to the older ionization methods in which singly-charged ions are much more prevalent. These multiply-charged ions can be mass-analyzed with an instrument with much less mass range (thomson range) than would be needed for the corresponding singly-charged ions because the ratio m/z varies inversely with charge. Even proteins may produce ions of m/z less than 1000 because of the large number of charges.

However, since the number of charges varies, the determination of the mass requires a determination of both the thomsons of the measured ion and the number of charges on the measured ion. Since such complex ions exist as a population of ions with isotope peaks separated by integral mass values, the number of charges on each ion can be determined by measuring the thomsons between successive mass peaks: doubly charged ions yield peaks at every ½ thomson, triply-charged ions yield peaks at every ⅓ thomson, and so on. This requires resolution that is typically not attainable on conventional linear quadrupole instruments, although the required resolution is not generally as large as that required for the separation of isobars. The invention described here allows high resolutions (narrow peak widths) to be achieved in a quadrupole ion trap operated in the mass-selective instability mode with resonance ejection. Both applications discussed above will be demonstrated.

Figure 3:
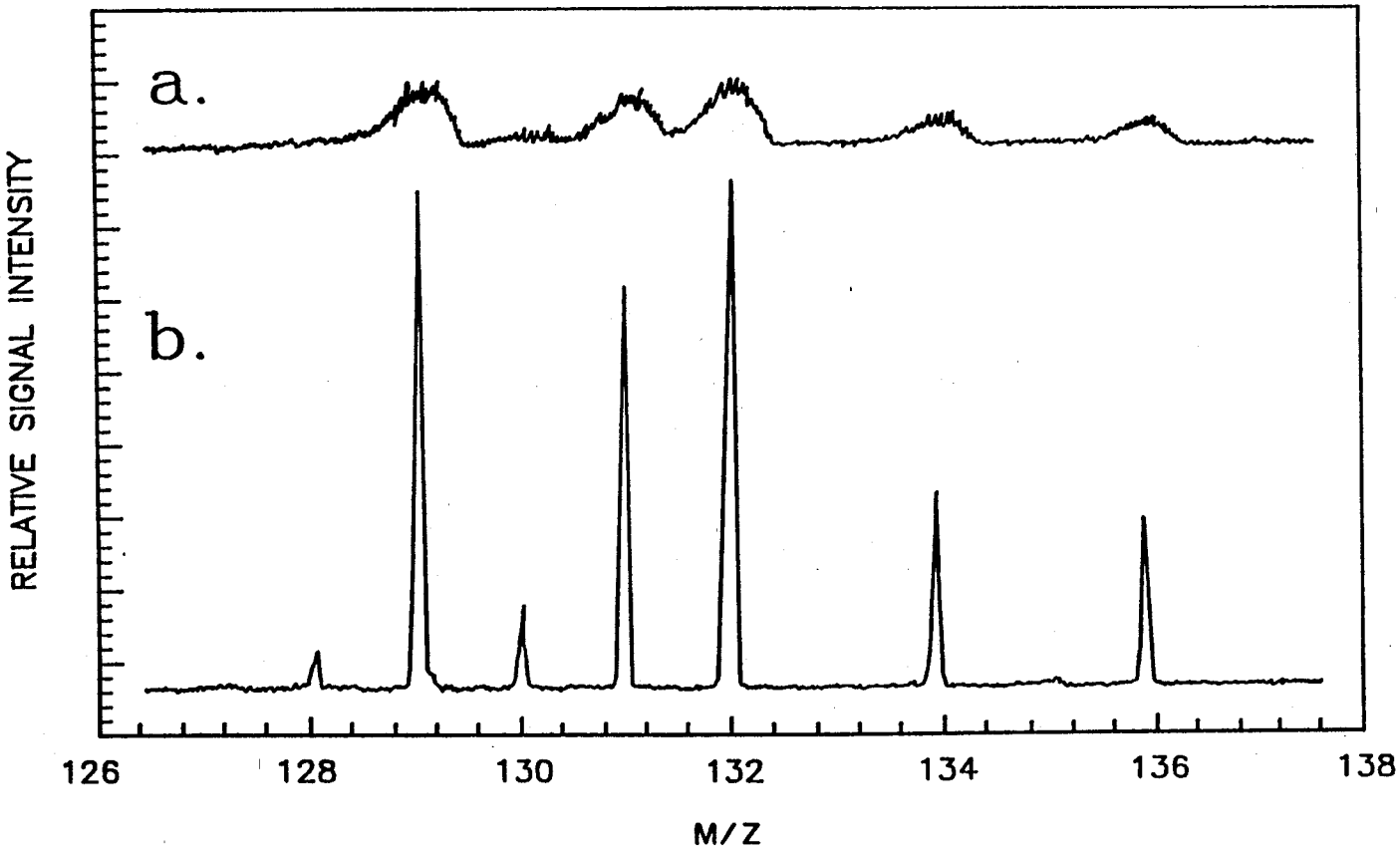
FIG. 3 is a spectrum of xenon acquired using a slow scanning rate for the r.f. voltage (4000 volts/second, 0-peak, or 1/16 the usual rate), using (a) the mass-selective instability mode of operation and (b) the mass-selective instability mode with resonance ejection (400 KHz).

Until recently, the usual method of operating ion trap mass spectrometers was the mass-selective instability mode in which the r.f. voltage on the ring electrode is scanned and ions of successive thomsons become unstable as they cross the boundary of the stability diagram at the coordinate $a_z=0$ and $q_z=0.908$. In the commercial instrument, the r.f. voltage is scanned at about 64000 volts/s (peak). Much faster scan rates result in decreased resolution, but slower scan rates do not greatly enhance the resolution. FIG. 3*a* shows a spectrum of xenon obtained at 1/16 this scan rate; the resolution is essentially the same as that obtained at the usual scan rate. When the scan speed is increased by a factor of 16, the resolution is slightly poorer than unit resolution. The commonly-used scan rate was chosen to provide unit resolution with a relatively rapid scan.

Previous workers, when modifying trapping parameters (such as the trap dimension r0) attempted to return the "scan rate", expressed in terms of thomsons/second, to a value similar to that used in the standard mode of operation of the commercial instrument (5000 thomsons/second) in the hope of restoring unit resolution. This was also true for early work with the mass-selective instability mode with resonance ejection in which the effective scan rate is increased through the ejection at $\beta$ values substantially less than one. However, it was assumed that substantially slower scanning would not yield substantially greater resolution, as is the case with the mass-selective instability mode of operation.

The unanticipated finding and an essential feature of the invention described here is that substantially slowing the scan speed using the mass-selective instability mode with resonance ejection does in fact lead to resolutions substantially better than those obtained with the mass-selective instability mode (or with the mass-selective instability mode with resonance ejection using scan rates comparable to those commonly used in the mass-selective instability mode). FIG. 3*b* shows a spectrum of xenon obtained using this method; the scan rate is 4000 v/s (as in FIG. 3*a*) but the spectrum is obtained with resonance ejection ($\beta=0.89$). In contrast to FIG. 3*a*, the resolution is considerably better than unit resolution.

The difference in behaviors in the resonant ejection and non-resonant ejection experiments is evidently due to the nature of the growth in the trajectories as the ions near ejection; at the edge of the stability boundary ions become unstable only at the edge itself but in the presence of a resonating field, the trajectories can grow much before resonance is actually achieved. With resonance ejection, the problem of distinguishing the thomson values of two ions of similar thomson value is essentially the problem of distinguishing the two similar, secular frequencies. The resolution is enhanced, therefore, if the peaks of the mass spectrum are ejected at such a rate that the ratio of the number of periods of the supplementary field to the rate of ejection in thomsons per second is increased. In particular, we find that rates slower that 200 supplementary field cycles per thomson yield useful enhanced resolutions spectra (the $\beta$ of ejection must not be too great).

When using the mass-selective instability mode of operation with resonance ejection, under the appropriate conditions, a relationship exists between resolution and the interaction time of the ion with the supplementary field. That is, the longer the ion interacts with the supplementary field before it is ejected, the more it will become resolved. Using this mode of operation, both the amplitude of the supplementary field and the scan speed (in this case the rate of change in the primary r.f. field amplitude) will affect this interaction time, and therefore the resolution.

Figure 8:
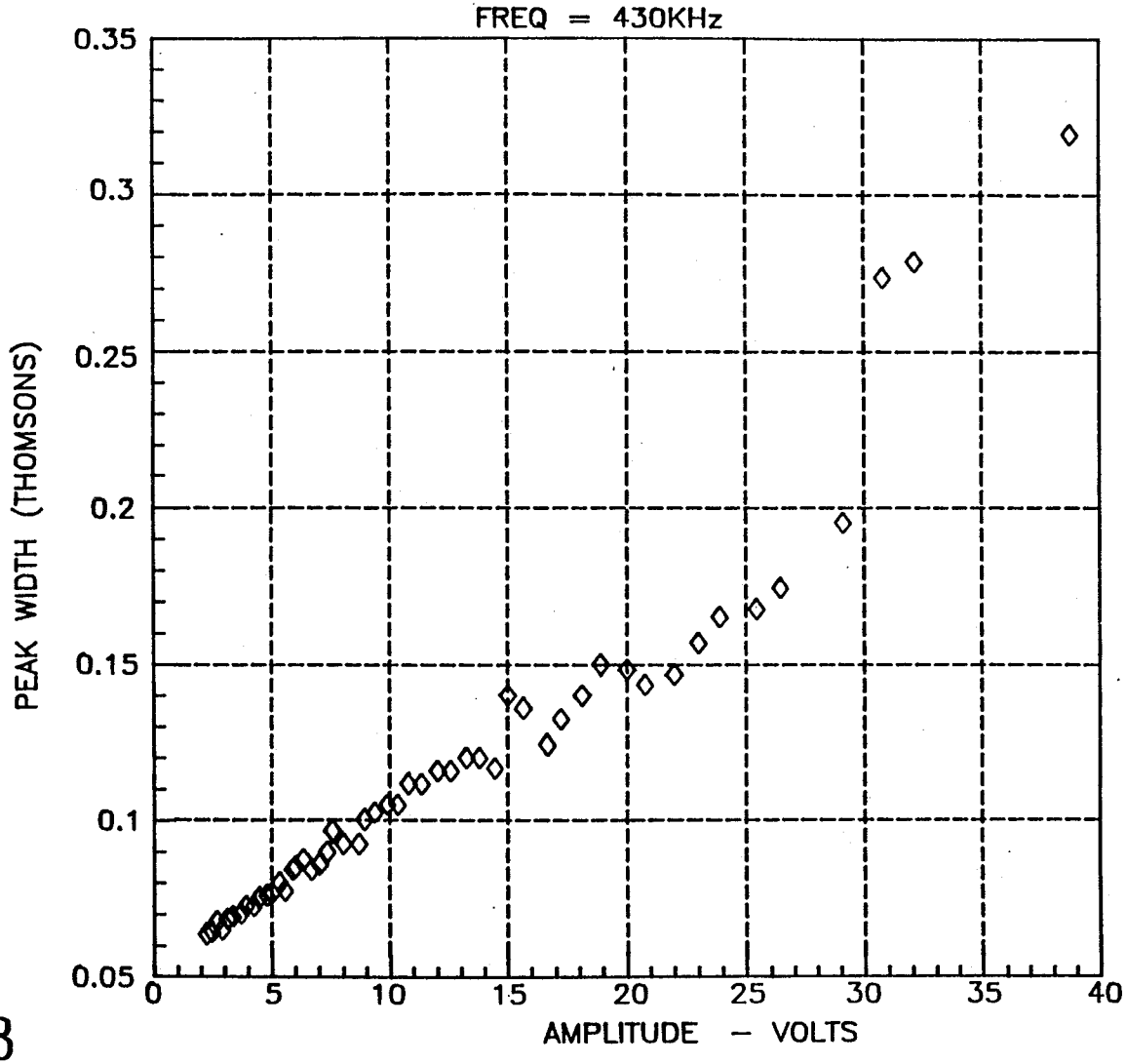
FIG. 8 shows the peak-width as a function of supplementary field amplitude at a $B_{z\text{-}eject}$ of 0.781818 (430 kHz).
Figure 9:
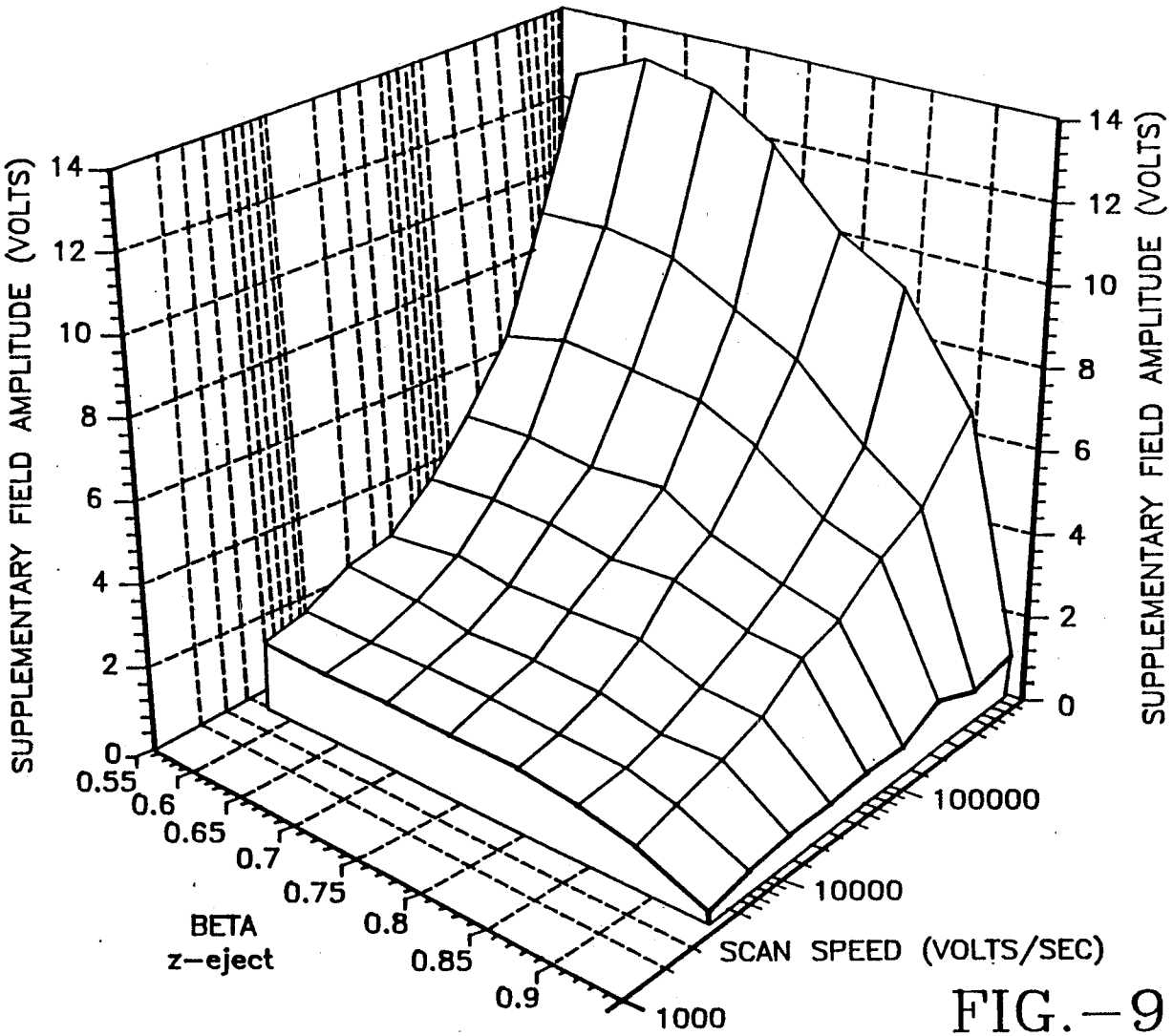
FIG. 9 shows the optimum voltage for best resolution as a function of scan speed and $\beta_{z\text{-}eject}$.

The amplitude of the supplementary field is important in obtaining high resolution because the lower the amplitude of the supplementary field, the slower the amplitude of an ions trajectory increases, therefore maximizing the interaction time before its ejection. FIG. 8 is a representative plot of peak-width (in thomsons) as a function of supplementary field amplitude for a $\beta_{z\text{-}eject}=0.781818$ (430 kHz) and a scan speed 1/16 the normal Rf amplitude scan rate. The data demonstrates this phenomenon experimentally showing that the peak width decreases with decreasing amplitude. However, the ability of the supplementary field's amplitude to enhance resolution is bounded by the primary parameter of scan speed. That is, high resolution is ultimately obtained by using relatively low scan speeds in conjunction with an appropriately low amplitude supplementary field at the appropriate frequency. The amplitude required for a particular experiment is complicated by the fact that it can be dependent on the number of ions in the trap as well as the mass of the ions being ejected. In general though and for all spectra shown in the figures, the amplitude of the supplementary field is kept at the minimum level, which still caused efficient and favorable ejection of ions. This minimum level tends to decrease with decreased scan speed as is illustrated in FIG. 9.

The frequency of the supplementary field is also an important parameter for achieving optimum resolution. By selecting the frequency of the supplementary field one of the $\beta$ lines shown in the diagram of FIG. 2 is selected thereby determining $\beta_{z\text{-}eject}$. As described earlier, as the r.f. voltage is increased, ions of successively increasing m/z approach the $\beta_{z\text{-}eject}$ and are brought toward resonance whereby their amplitude of motion increases and they are ejected from the ion trap. As the selected frequency of the supplementary r.f. field is decreased, lower $\beta$ lines are selected which approach $\beta=0$. As the lower value $\beta$ lines are selected, less r.f. voltage amplitude is required to bring an ion of given m/z into resonance. In general, the thomson range which can be scanned out is limited by the maximum value of r.f. voltage which can be applied. Therefore resonant excitation at lower values of $\beta$ increases the thomson range of the instrument. Given a fixed r.f. amplitude (or other field) scan rate, the supplementary field frequency will also affect the scan rate in units of thomsons/second of the instrument. For a fixed rate of change of the r.f. amplitude, the lower the $\beta_{z\text{-}eject}$, the higher the thomson range and the higher the scan rate in terms of thomsons/second.

Figure 6:
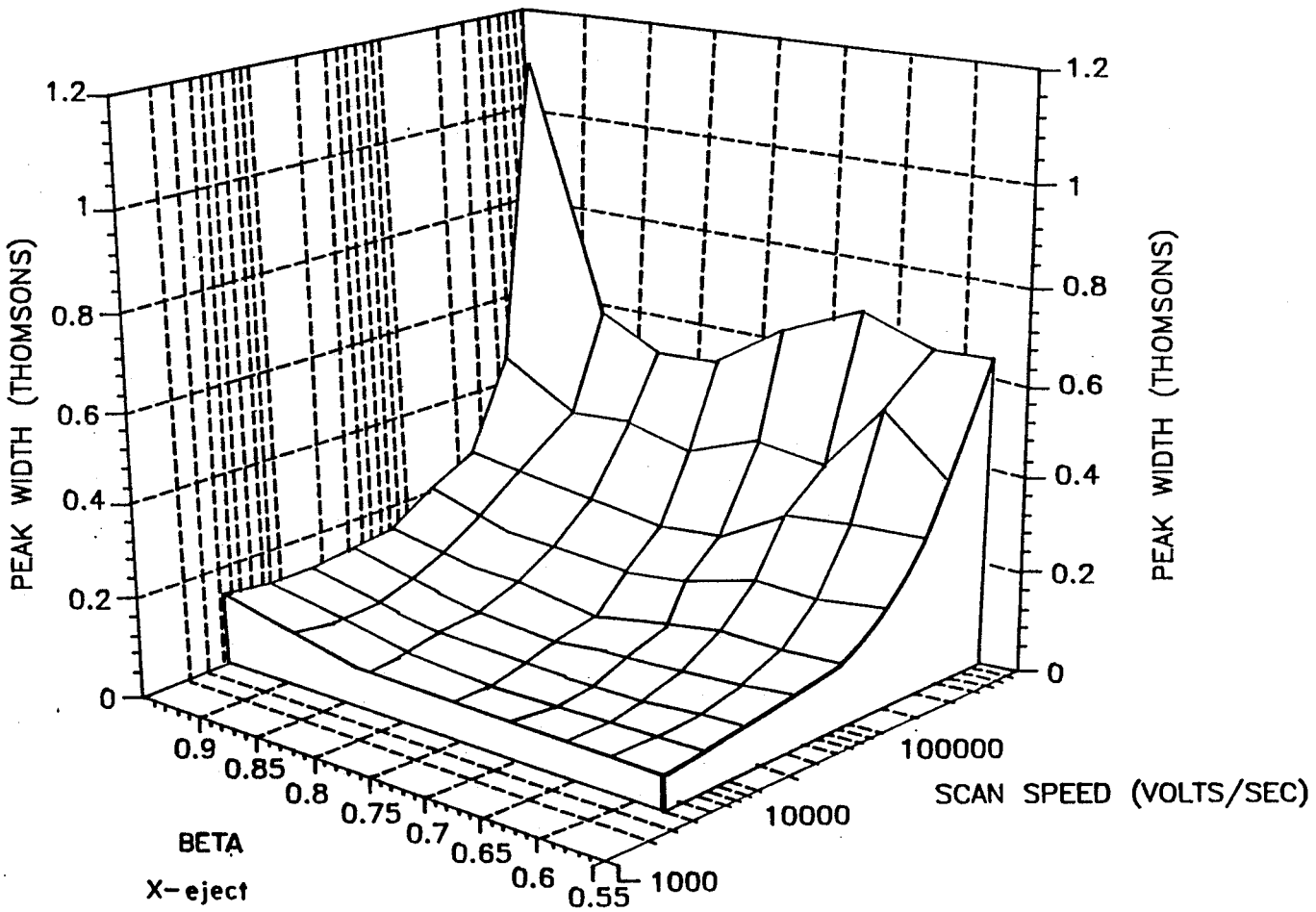
FIG. 6 is a three-dimensional plot showing peak width as a function of scan speed and $\beta_{z\text{-}eject}$ determined by the supplementary r.f. field frequency applied to the end caps.
Figure 7:
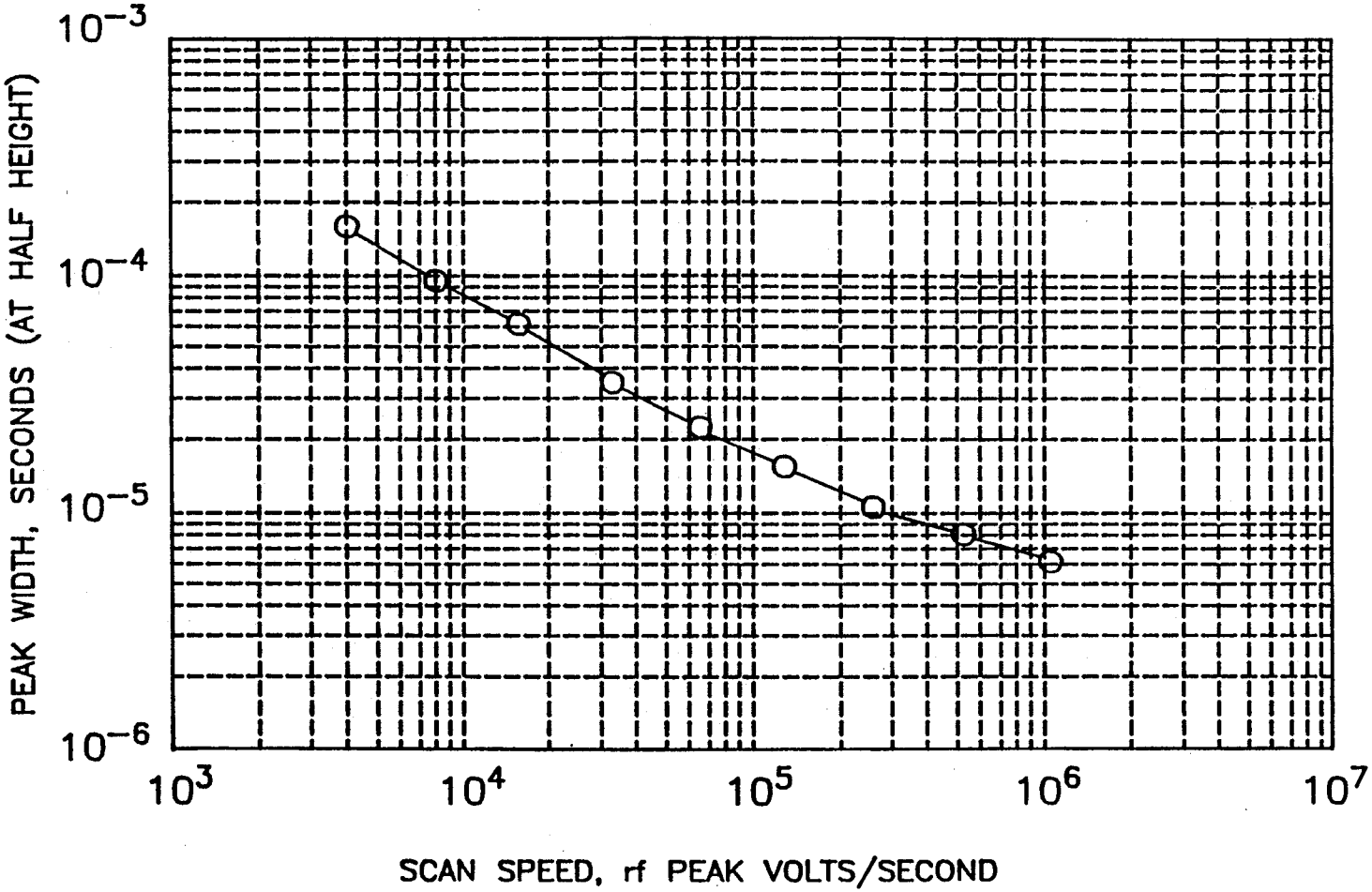
FIG. 7 shows the peak-width (in seconds) as a function of r.f. scan rate for a supplementary frequency at a $\beta_{z\text{-}eject}$ of 0.727273 (400 kHz).

In these studies, significant reduction in peak width (increased resolution) has been obtained when using $\beta_{z\text{-}eject}$ values between 0.0710 and 0.891. The smallest demonstrated peak widths are obtained with $\beta_{z\text{-}eject}$ values in the range between 0.710 and 0.891. This may be accounted for, in part, by the fact that it was possible to achieve lower scan rates in terms of thomsons/-second when using the higher $\beta_{z\text{-}eject}$ values since substantial thomson range extension is realized when $\beta_{z\text{-}eject}$ is dropped below 0.710. In this case, one effectively trades resolution for an increase in the thomson range, but the resolution can be partly recovered by scanning the field appropriately slower. With resonant ejection near the stability limit of $\beta=1.000$ (550 kHz, q=0.908), reduction in the scan rate much below the standard scan rate does not result in significant improvement in resolution. FIG. 6 shows a three-dimensional plot of peak width (in thomsons) of m/z 129 of xenon as a function of scan rate (log r.f. volts/sec) and $\beta_{z\text{-}eject}$ (supplementary frequency) which shows experimental data which support the statements made in the above discussion. As can be seen, peak width continues to decrease with decreasing scan speeds, when using appropriate supplementary field frequencies. Each data point in this plot was obtained using the supplementary field amplitude that produced the narrowest peak width.

Figure 4A:
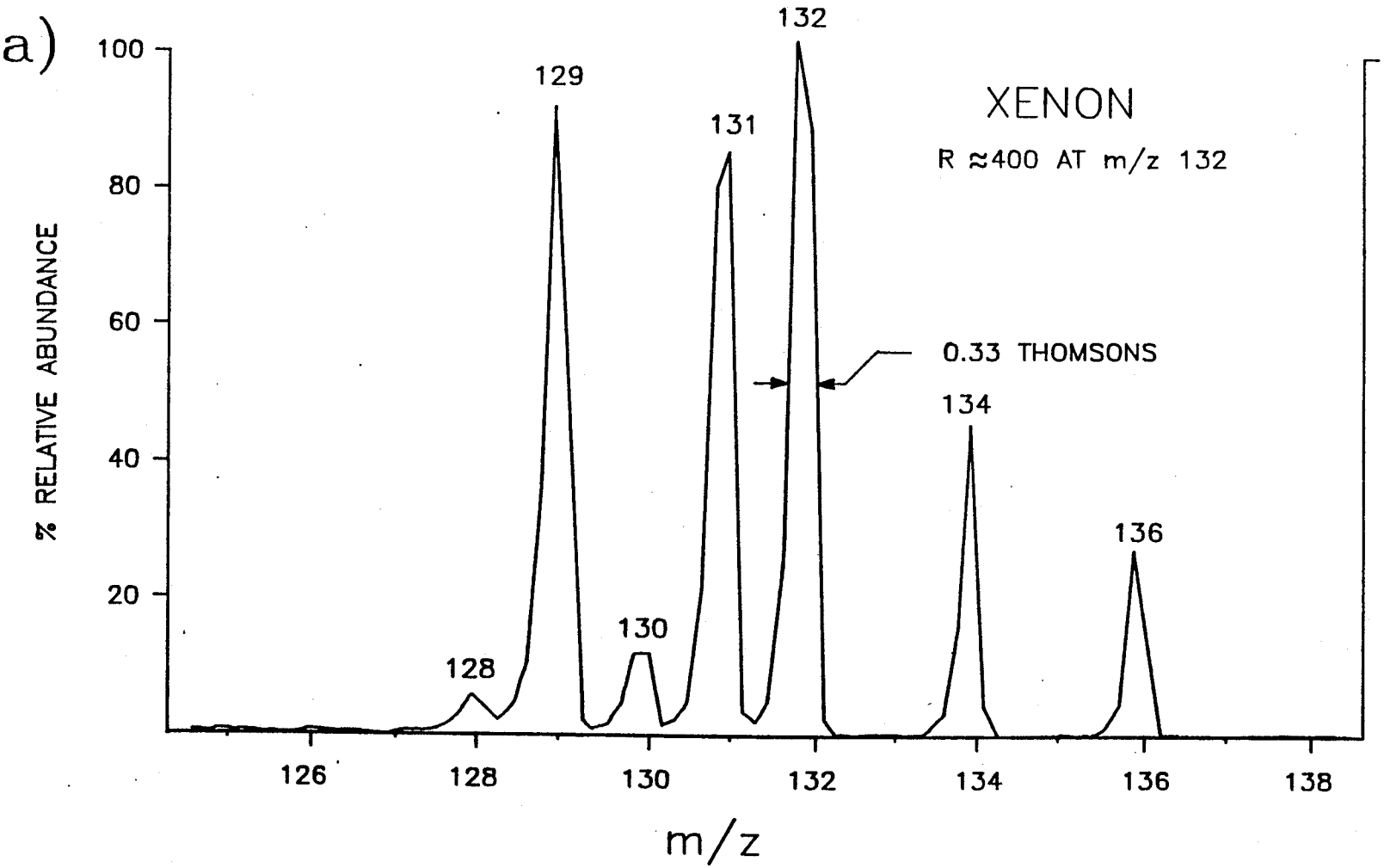
FIGS. 4*a*–4*c* are xenon spectra (a) using the normal scanning rate for the peak r.f. voltage of 64000 volts/-second; (b) using 3200 volts/second; and (c) m/z 131 and 132 scanned at 640 volts/second.
Figure 4B:
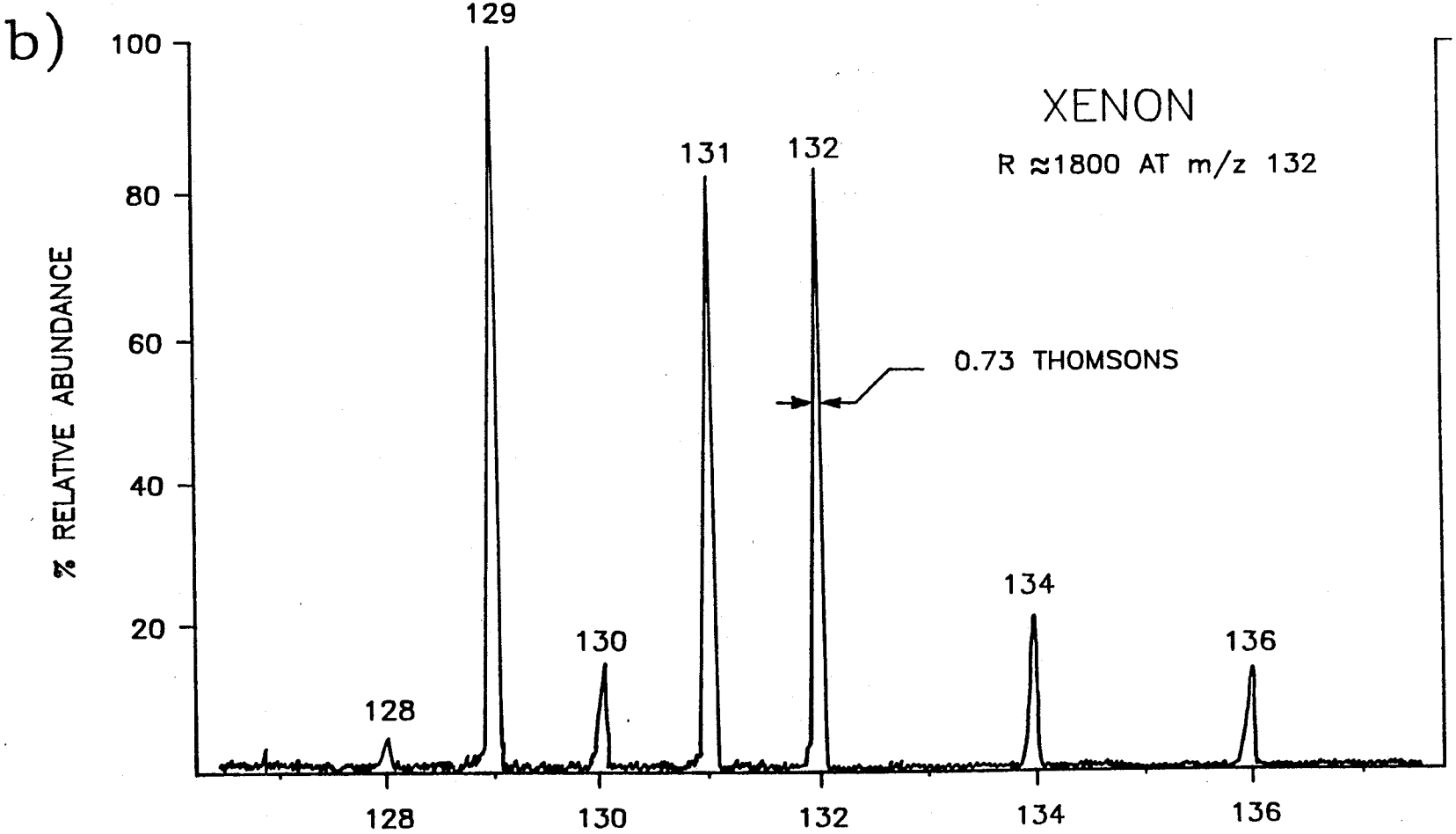
Figure 4C:
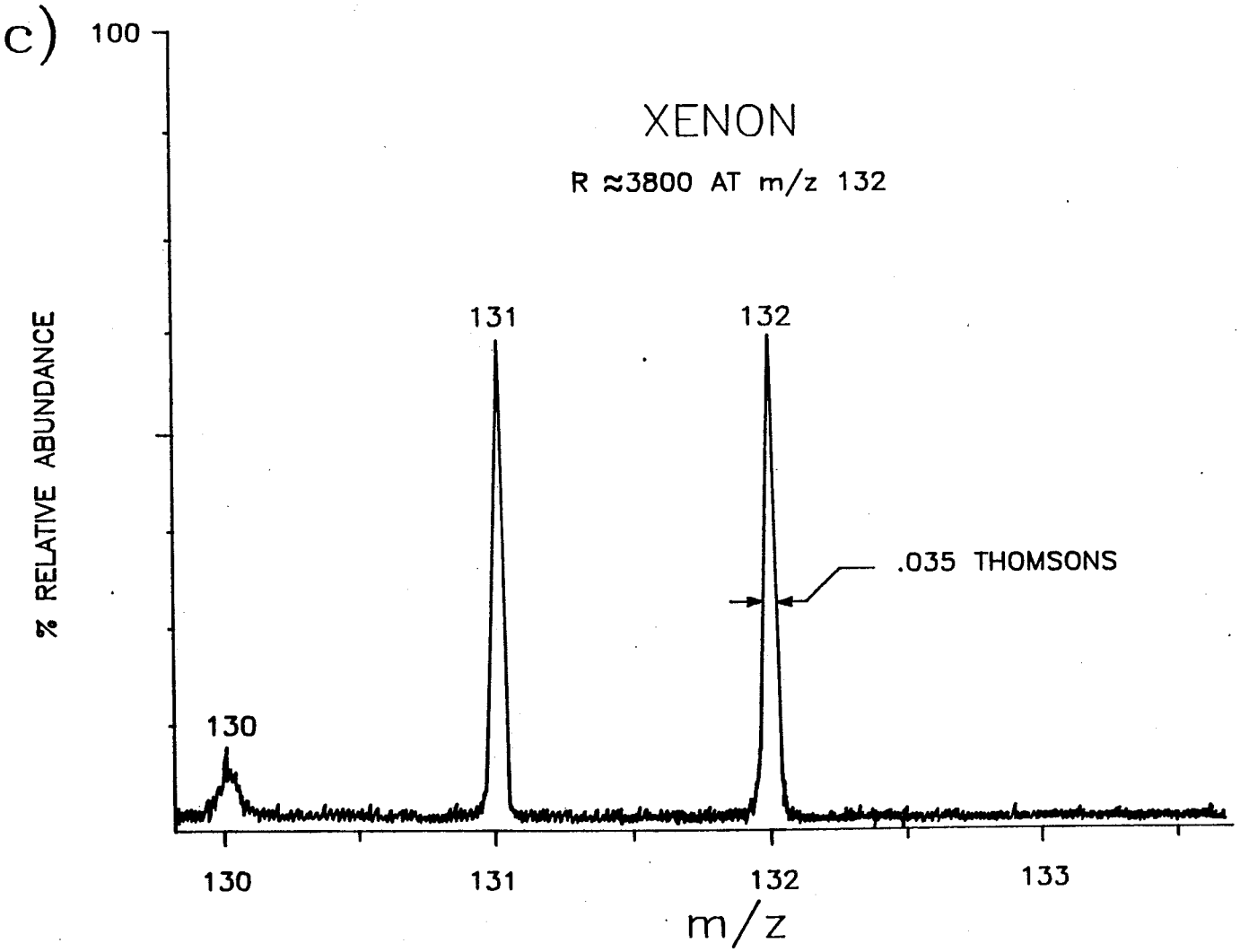

The following results show operation of the ion trap to verify our discovery that high resolution can be achieved by using the appropriate supplementary field amplitude and frequency, and by sufficiently slowing the scan rate. An external electron ionization source was used for ionization and ions were subsequently injected into the trap. A buffer gas pressure of approximately $1\times10^{-3}$ Torr of helium was used for all experiments described herein. The spectrum of xenon with all its isotopes acquired under normal operating conditions, including a scan speed of 64000 volts/second (volts expressed as 0 to peak volts), thomson range of approximately 650 thomsons, and resonance ejection at a $\beta_{z\text{-}eject}$ of 0.945454 (520000 Hz) with 6.0 volts amplitude, is displayed in FIG. 4*a*. These conditions yield typical peak-widths of 0.33 thomsons at FWHM and, therefore, a resolution of approximately 400 at m/z 132. FIG. 4*b* shows the full isotope cluster of xenon at a scan speed of 1/20 the normal scan speed, i.e., 3210 volts/second, using resonance ejection at $\beta_{z\text{-}eject}$ of 0.733 (403017 Hz) and an amplitude of 4.5 volts (peak-to-peak, across the end-cap electrodes). The peak-width of m/z 132 at FWHM has been reduced to approximately 0.073 thomsons, and therefore giving a resolution of approximately 1800. FIG. 4*c* shows a portion of the xenon isotope spectrum including the abundant isotopes of m/z 131 and 132 under conditions of 1/100 the scan speed (640 volts/second) using a resonance frequency at a $\beta_{z\text{-}eject}$ of 0.661 (363543 Hz) and an amplitude of 4.6 volts. The peak-width of the m/z 132 peak at FWHM is shown to be approximately 0.035 thomsons, giving a resolution of approximately 3800 at this m/z.

Figure 5A:
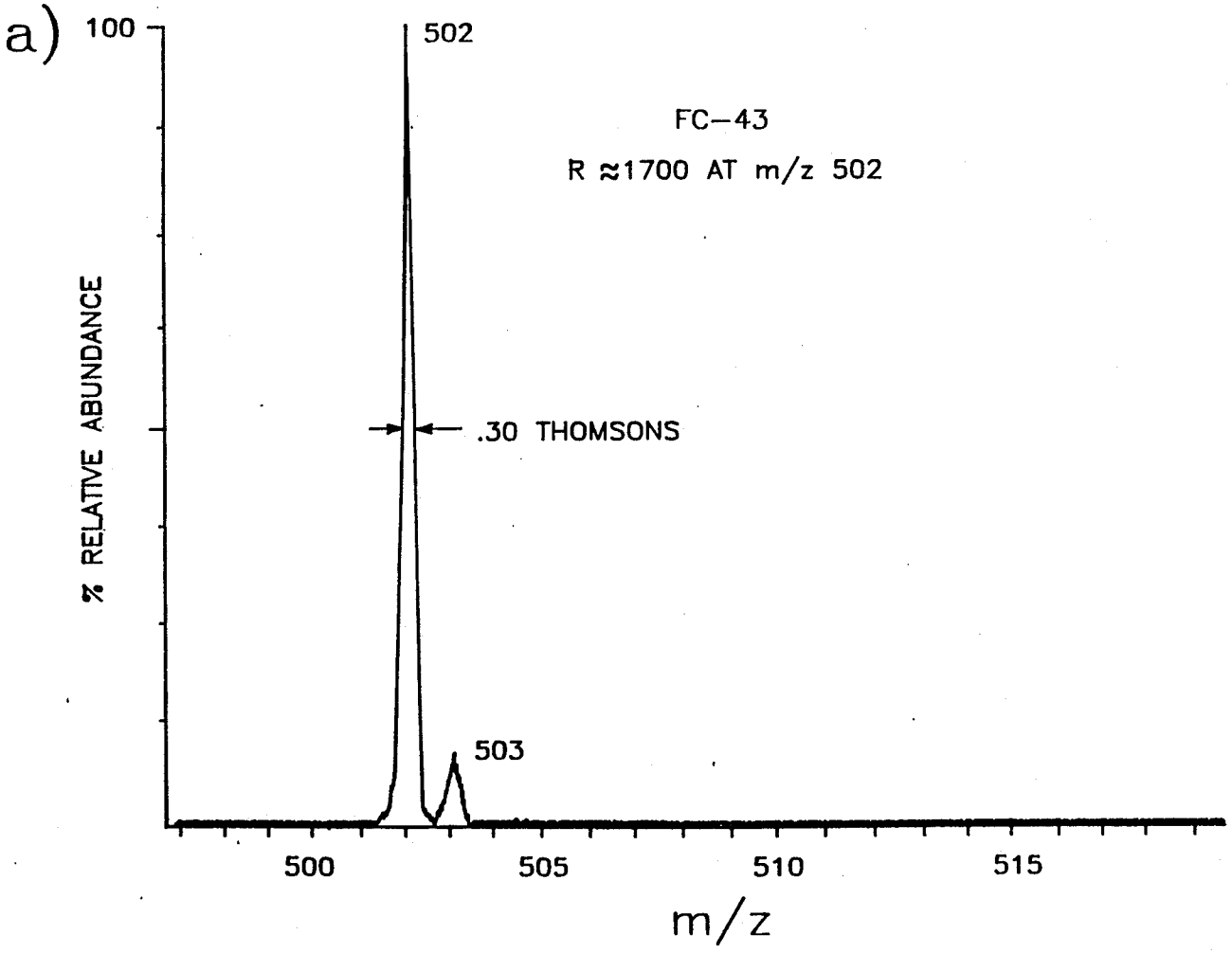
FIGS. 5*a*–5*c* are spectra for m/z 502 of perfluorotributylamine (FC-43) (a) using normal scan speed 64000 volts/second; (b) 640 volts/second scan speed; and (c) using 320 volts/second scan speed.
Figure 5B:
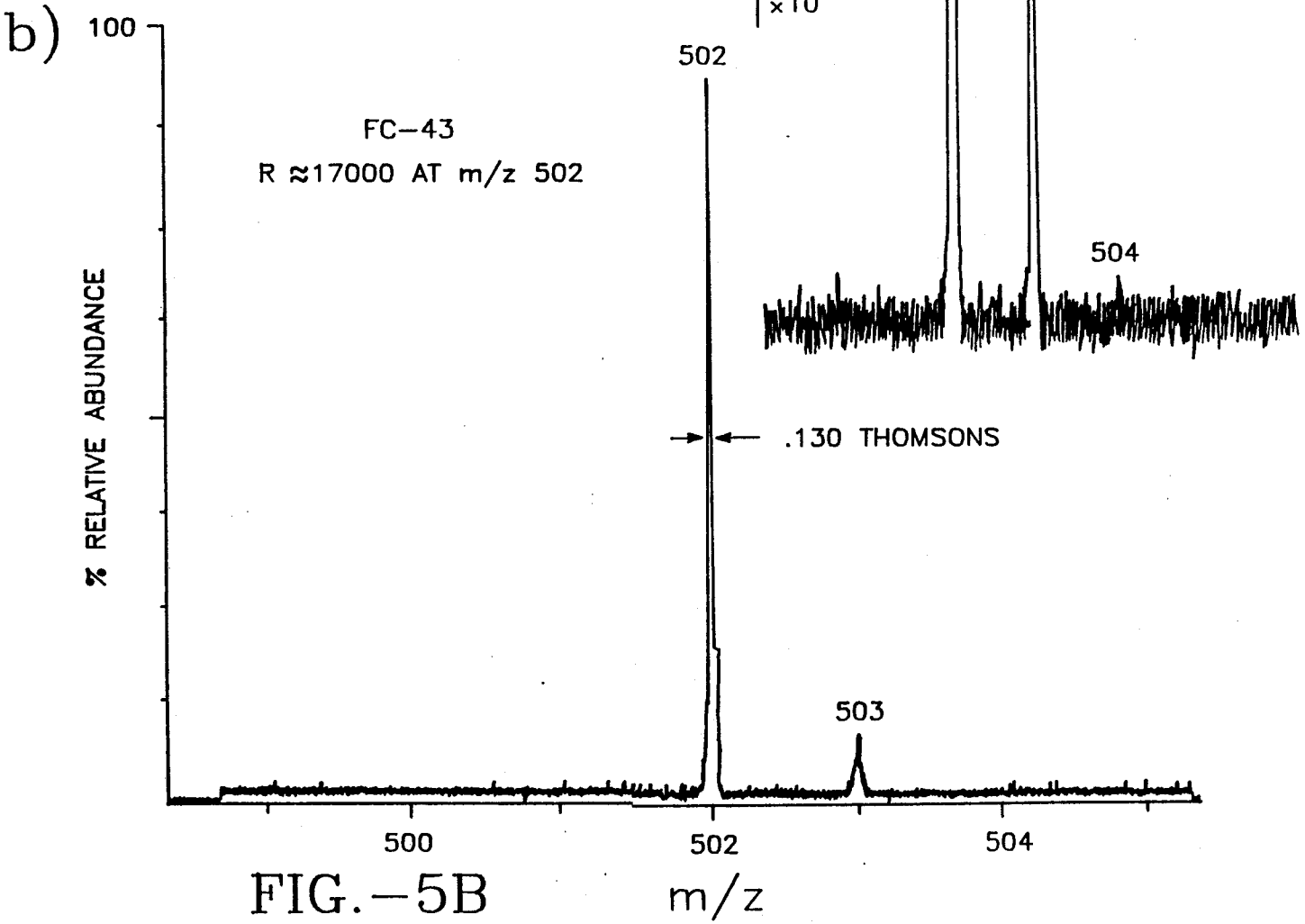
Figure 5C:
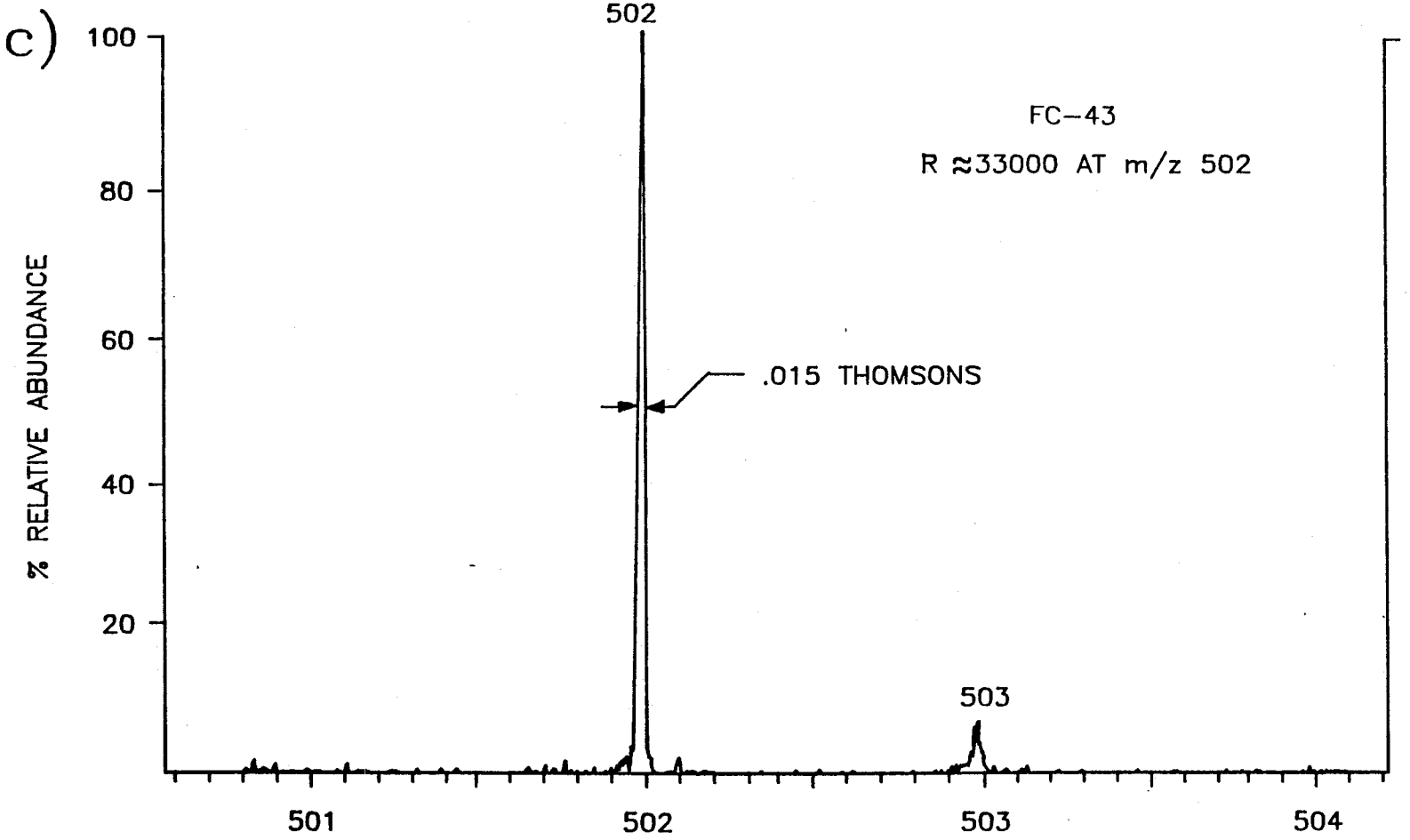

Achievement of considerably higher resolution with an ion trap mass spectrometer is demonstrated in FIG. 5, which shows data using the higher m/z 502 and 503 peaks of the mass spectrum of perfluorotributylamine (FC-43) ionized by using an external electron ionization source. FIG. 5*a* shows the mass spectrum that was acquired by using a normal scan speed of 64000 volts/-second and resonance ejection at a $\beta_{z\text{-}eject}$ of 0.945454 (520000 Hz) and an amplitude of 6.0 volts, indicating typical peak-widths and resolution (1700) under standard operating conditions. FIG. 5*b* shows the same mass spectrum at a scan speed of 640 volts/second, a supplementary frequency at a $\beta_{z\text{-}eject}$ of 0.852042 Hz, (468623 Hz) and an amplitude of 1.1 volts. The insert shows that by increasing the gain and the number of scans averaged, m/z 504 may also be observed. The peak-width of m/z 502 is approximately 0.030 thomsons (FWHM), and thus the resolution is approximately 17000. This peak-width is comparable to the peak-width seen in FIG. 4*c* and demonstrates the constant peak-width in thomsons produced by the ion trap throughout the thomson range and, therefore, its increasing resolution with increasing m/z. In FIG. 5*c*, the scan rate has been attenuated by a factor of 200 to 320 volts/second, with a supplementary field frequency at a $\beta_{z\text{-}eject}$ of 0.848405 (466623 Hz) and an amplitude of 0.58 volts. The peak-width at FWHM of m/z 502 is approximately 0.015 thomsons, and thus the resolution is 33000.

Figure 10:
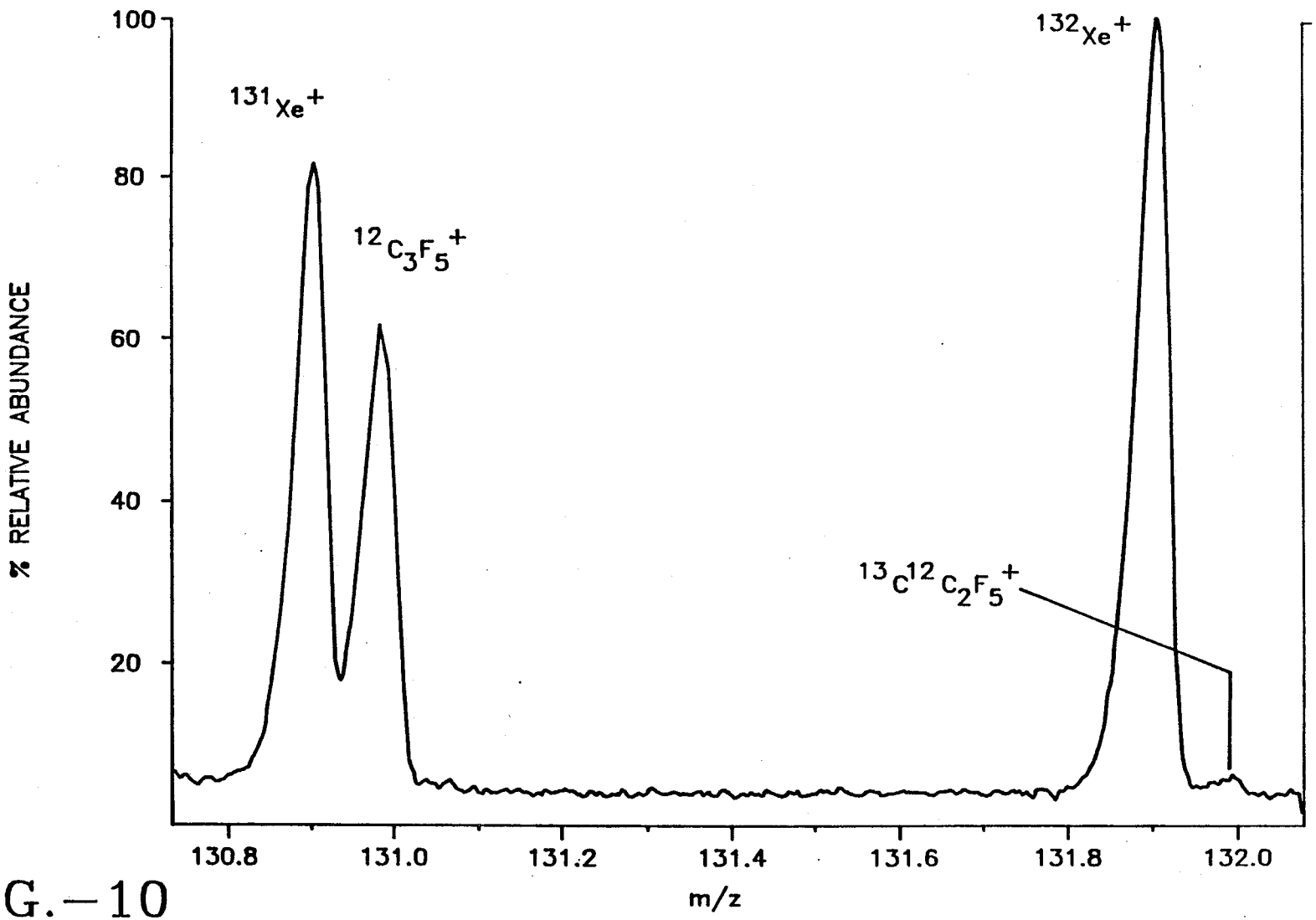
FIG. 10 slows the separation of the isobaric species of $^{131}Xe$ and $^{12}C_3F_5$ both at nominal m/z 131 and $^{132}Xe$ and $^{13}C_3F_5$ at nominal m/z 132.

FIG. 10 shows an example of the separation of isobars using the increased resolution obtainable by the method described here. The scan rate has been slowed by a factor of 500 to 128 volts/second with a $\beta_{z\text{-}eject}$ of 0.709091 (390000 Hz) and an amplitude of 2.2 volts. This spectrum shows the 131 xenon isotope resolved from that of a fragment ion ($C_3F_5$) of the compound perfluorotributylamine, both having nominal m/z values of 131. The atomic weight of $^{131}Xe=130.9051$ daltons, while the molecular weight of $^{12}C_3F_5=130.9920$ daltons, so that peak widths of approximately less than half of 0.0869 thomsons are required for the peaks to be completely resolved. The measured peak widths are approximately 0.045 thomsons at FWHM. Also shown is the next isotope of xenon at m/z 132 and the C13 containing ion ($^{13}C^{12}C_2F_5$) can also be observed.

Figure 11A:
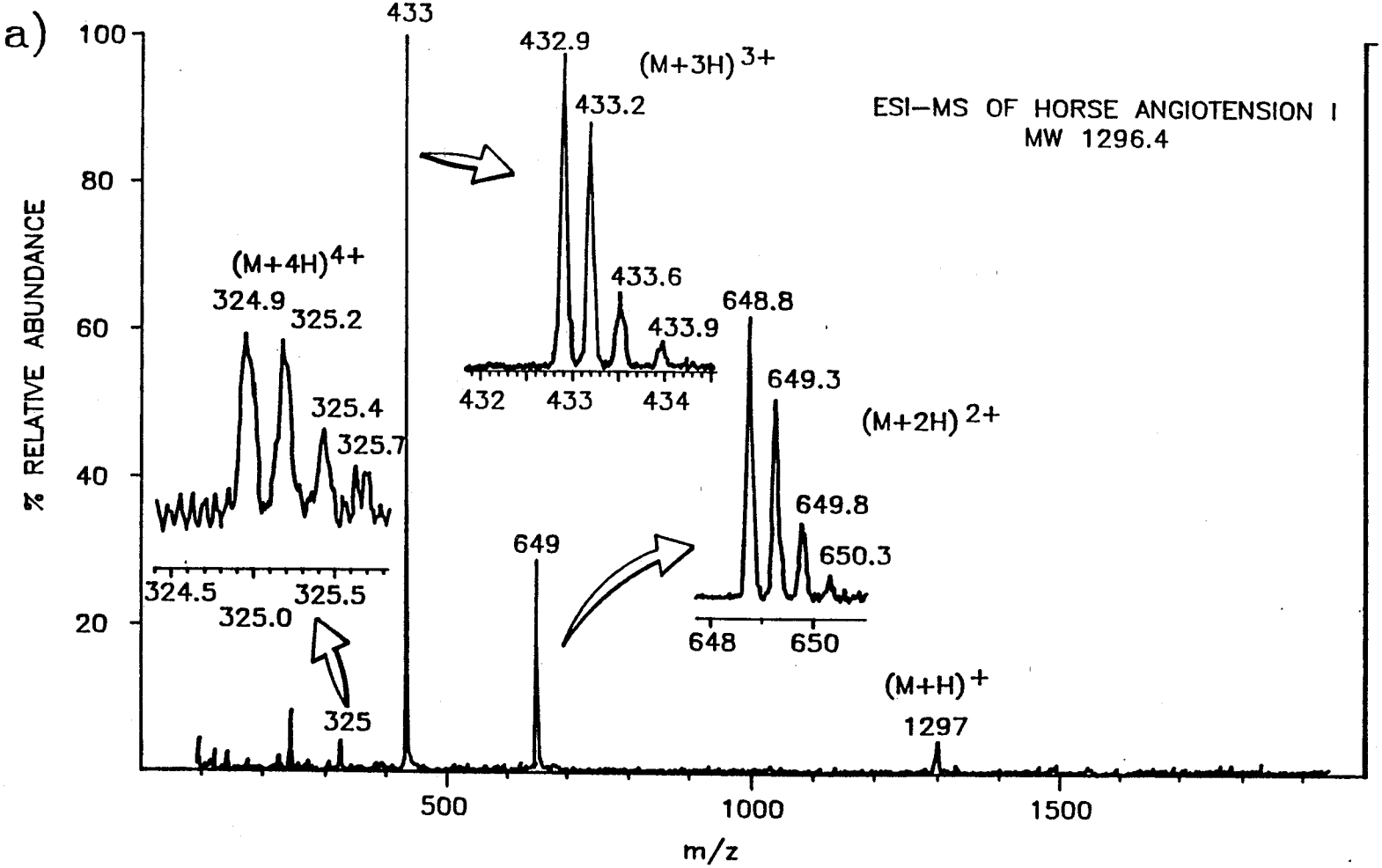
FIGS. 11*a*–*h* show electrospray ion trap data of multiply charged horse angiotensin I ions for different scan speeds and conditions. (a) Electrospray mass spectrum; (b) Daughter spectrum of $(M+3H)^{3+}$ at m/z 433; (c) Region 1 of (b) using a scan speed of 3140 volts/second; (d) Region 2 of (b) using a scan speed of 3140 volts/-second; (e) Region 3 of (b) using a scan speed of 3140 volts/second.
Figure 11B:
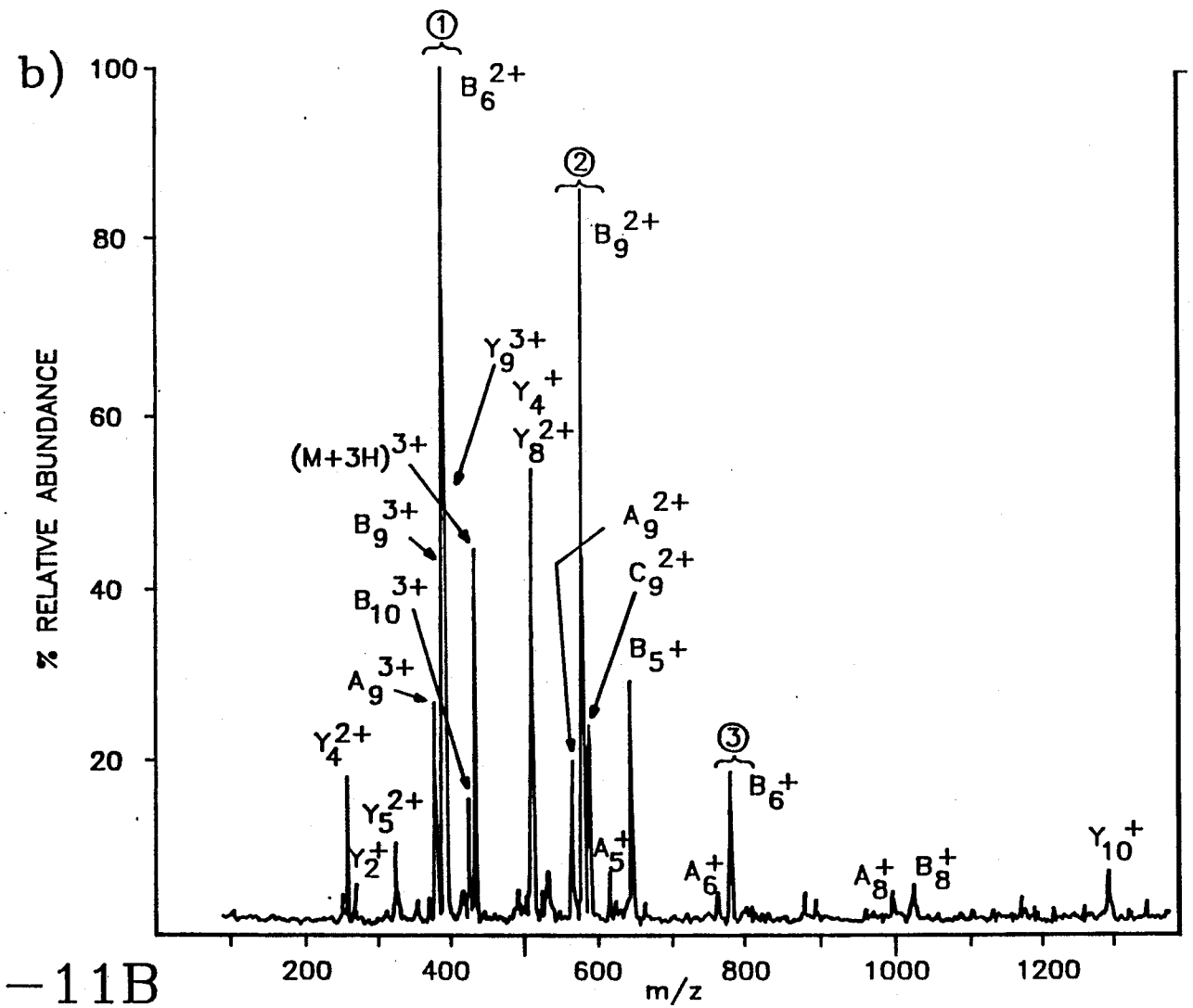
Figure 11C:
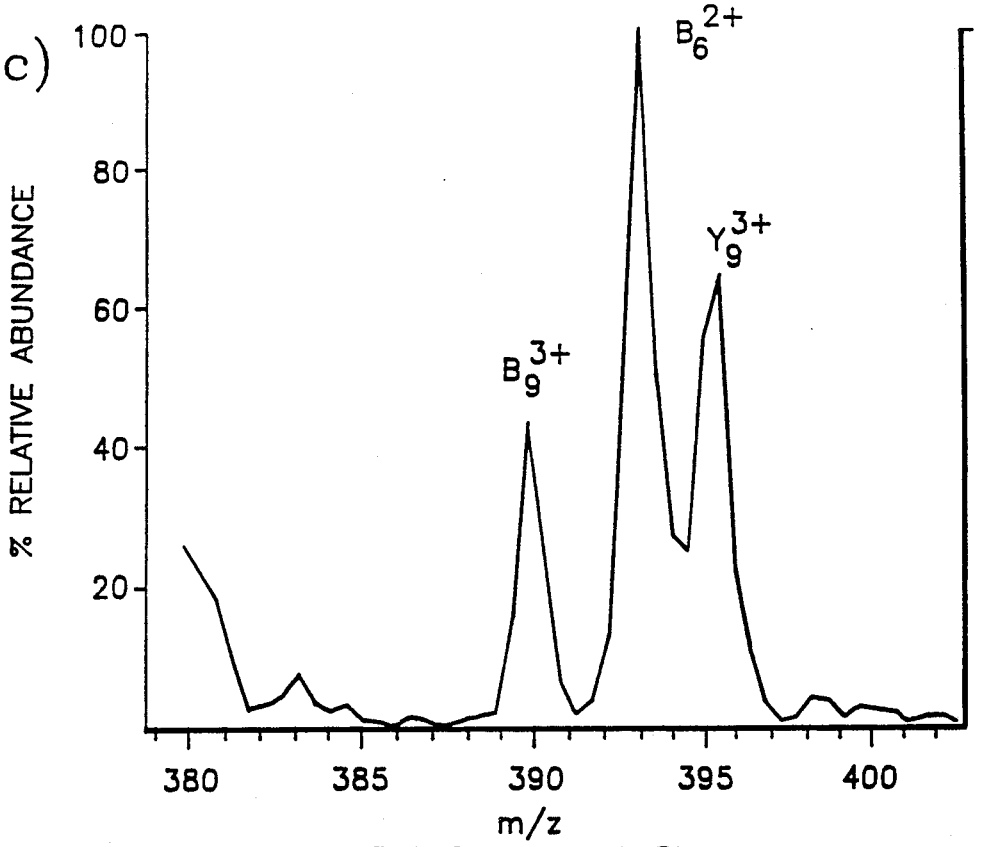
Figure 11D:
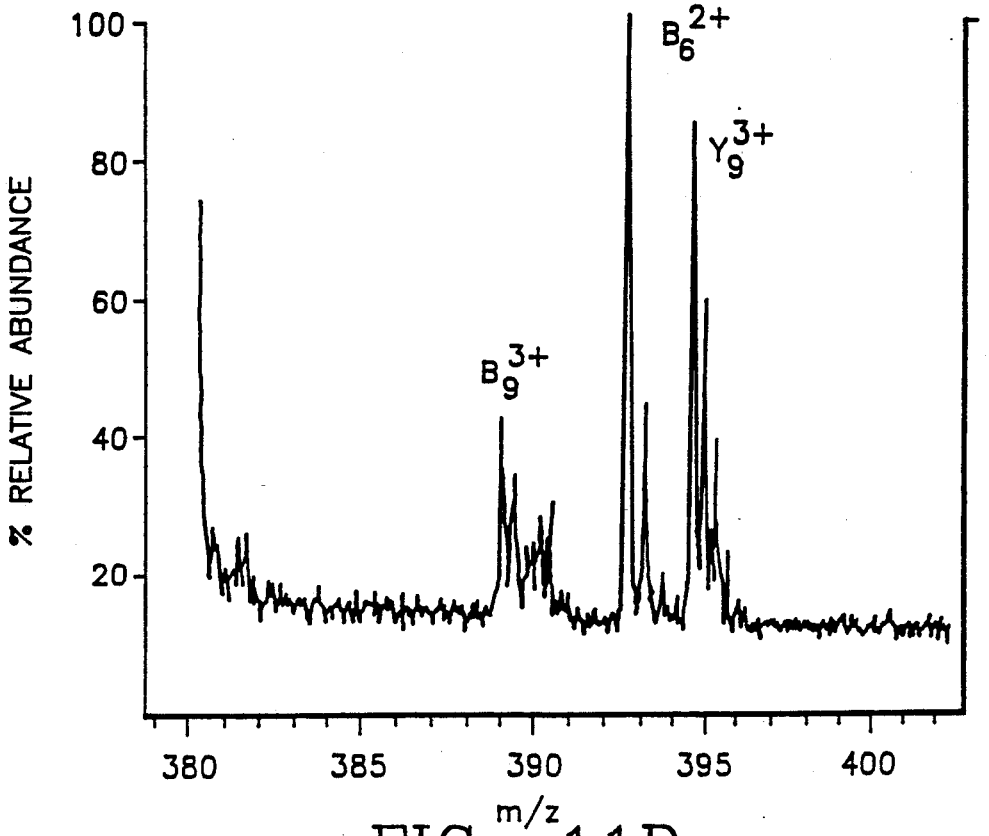
Figure 11E:
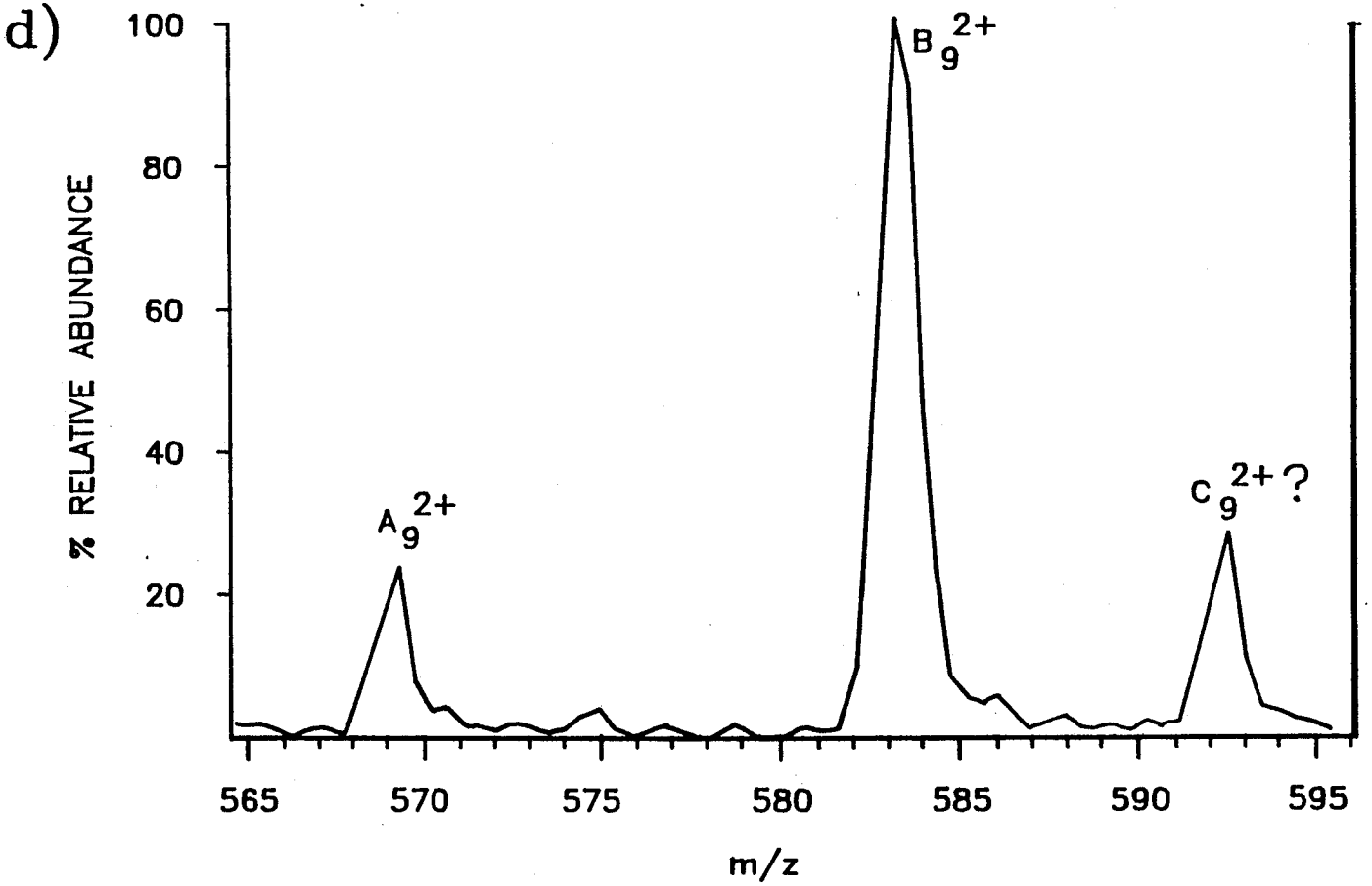
Figure 11F:
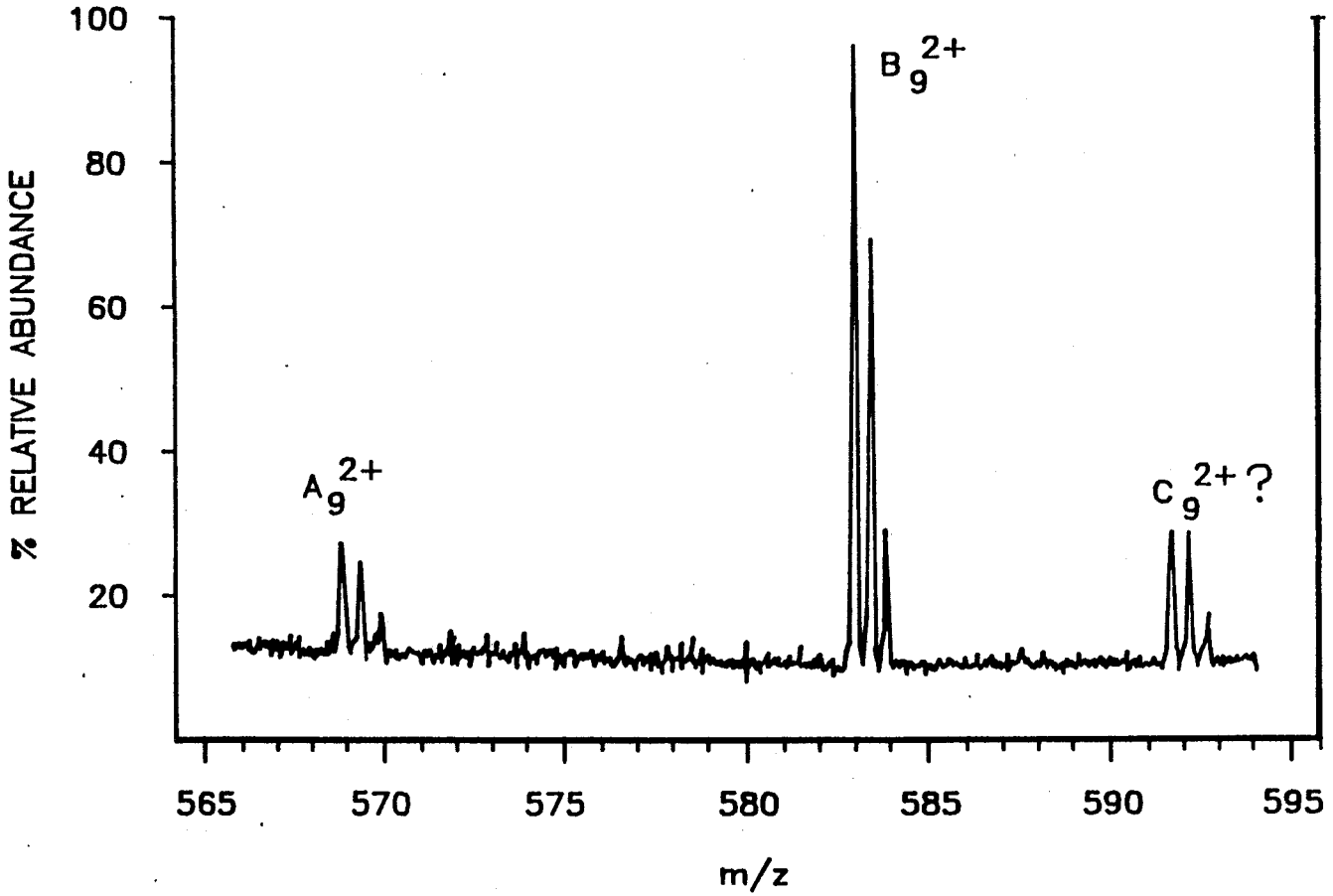
Figure 11G:
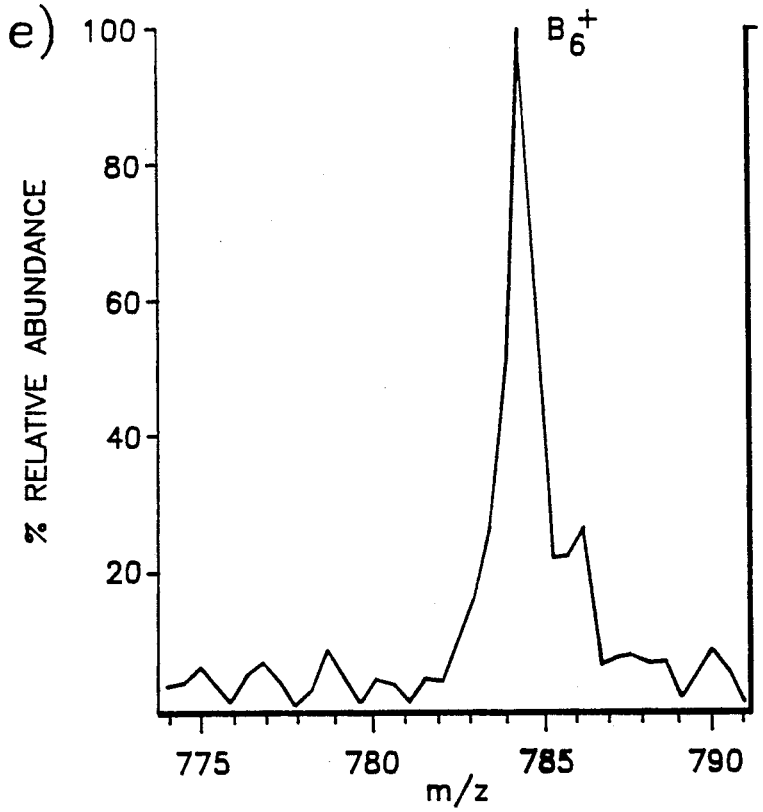
Figure 11H:
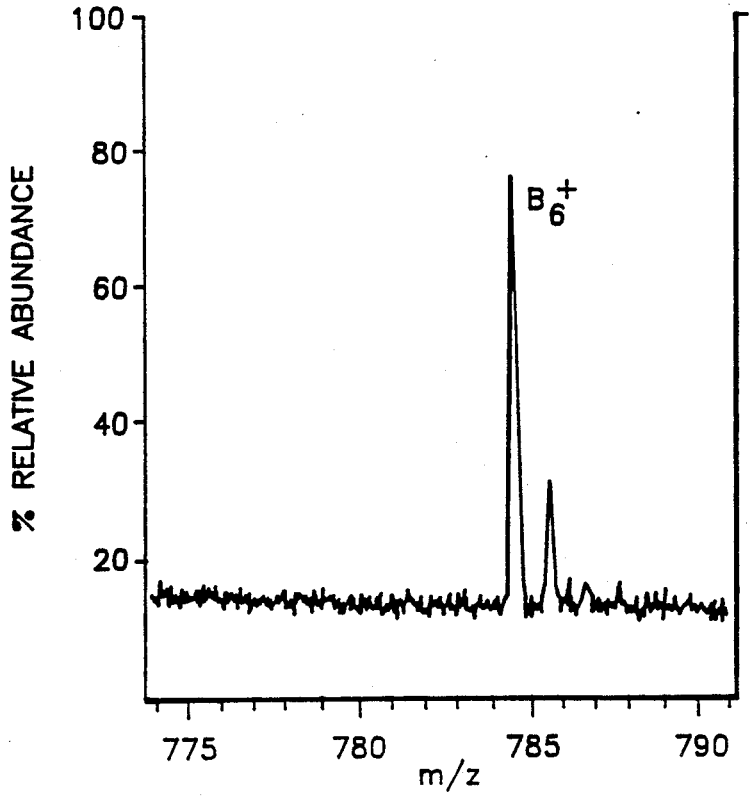

Among the many other possible applications, mass spectrometry for biochemical applications should particularly benefit from high resolution on the ion trap. As mentioned earlier, electrospray ionization has recently been coupled with the ion trap. Obtaining high resolution daughter ion mass spectra to help with the interpretation of peptide and protein sequencing data is also possible, potentially at even higher resolution than that obtainable on four-sector magnetic or Fourier-transform ion cyclotron resonance instruments. Some preliminary results demonstrating applications in these areas are described in the following figures. The electrospray ionization mass spectrum of the peptide horse angiotensin I is shown in FIG. 11*a*. This spectrum was obtained using resonance ejection at a $\beta_{z\text{-}eject}$ of 0.218065 (119936 Hz, $q_{z\text{-}eject}=0.303$), resulting in a thomson range of 1950, and using the standard scan speed of 64000 volts/second. The singly, doubly, triply and quadruply protonated ions are indicated. Scanning more slowly across the multiply charged ions using a scan rate of 3140 volts/second and a resonance ejection frequency at a $\beta_{z\text{-}eject}$ of 0.844311 (464371 Hz) provides isotopic separation of these species, as displayed in the inset windows. This scan speed yields a peak-width (approximately 0.087 thomsons FWHM) that readily allows identification of the charge state for these pseudomolecular ions. The electrospray ionization MS/MS daughter ion mass spectrum of the $[M+3H]^{3+}$ ion at m/z 433 after its isolation and using a normal 64000 volts/second scan is shown in FIG. 11*b*. Fragment ions of the peptide are labeled using an established nomenclature which specifies at which amino acid fragmentation has occurred, and at which bond within the amino acid fragmentation has occurred, and which side of the peptide has retained the charge. FIGS. 11*c*–11*e* show small sections of the daughter spectrum (indicated in FIG. 11*b*) that have been obtained using a scan speed of 3140 volts/second and $\beta_{z\text{-}eject}$ of 0.844311. Again, the resolution achieved readily allows the identification of charge states for these daughter ions by using the mass separation of the isotopes and therefore, simplifies sequence ion assignments in the daughter ion mass spectrum.

Thus there has been disclosed a method of increasing resolution in the ion trap mass spectrometer operated in the mass-selective instability mode with resonance ejection by decreasing the rate of change of the scanning field as well as using the appropriate frequency and amplitude of the supplementary field.

What is claimed:

1. The method of operating anion trap mass spectrometer in the high resolution mode comprising the steps of defining a trap volume with a three-dimensional substantially quadrupole field for trapping ions within a predetermined range of mass-to-charge ratio, forming or injecting ions within said trap volume such that those within said predetermined mass-to-charge ratio range are trapped, applying a supplementary AC field superimposed on said three-dimensional quadrupole field to form combined fields, scanning said combined fields to resonantly eject ions of consecutive mass-to-charge ratio from said trap volume for detection characterized in that said supplementary field has an amplitude just sufficient to eject said ions, and said combined fields are scanned at a rate so that a length of time corresponding to 200 cycles or more of the supplementary AC field occurs per consecutive thomson.

2. The method as in claim 1 in which said supplemental field has a frequency to establish a beta value of ejection on the stability envelope of the ion trap below 0.891.

3. The method as in claim 1 in which said supplemental field has a frequency to establish a beta value of ejection on the stability envelope of the ion trap between 0.071 and 0.891.

4. The method as in claim 1 in which said supplemental field has a frequency to establish a beta value of ejection on the stability envelope of the ion trap between 0.710 and 0.891.

5. The method as in claim 1 in which said supplemental field has a frequency to establish a beta value of ejection on the stability envelope of the ion trap between 0.536 and 0.945.

6. The method of operating an ion trap mass spectrometer in a high resolution mode comprising the steps of applying an r.f. voltage V at frequency f and DC voltage U to an ion trap to define at trap volume with a three-dimensional substantially quadrupole field for trapping ions within a predetermined range of mass-to-charge ratio, forming or injecting ions within said trap volume such that those within said predetermined mass-to-charge ratio range are trapped within said trap volume, applying a supplementary AC field superimposed on said three-dimensional quadrupole field to form combined fields, scanning said combined fields to resonantly eject ions of consecutive mass-to-charge ratio from said trap volume for detection characterized in that said supplementary field has an amplitude just sufficient to eject said ions and said combined fields are scanned at a rate so that a length of time corresponding to 200 cycles or more of the supplementary AC field passes per consecutive thomson.

7. The method as in claim 6 in which the combined fields are scanned by scanning the amplitude of the r.f. voltage.

8. The method as in claim 6 in which the combined fields are scanned by scanning the amplitude of the DC voltage.

9. The method as in claims 6 or 7 in which a light buffer gas is introduced into the ion volume.

10. The method as in claims 6 or 7 in which said supplemental field has a frequency to establish a beta value of ejection on the stability envelope of the ion trap below 0.891.

11. The method as in claims 6 or 7 in which said supplemental field has a frequency to establish a beta value of ejection on the stability envelope of the ion trap between 0.071 and 0.891.

12. The method as in claims 6 or 7 in which said supplemental field has a frequency to establish a beta value of ejection on the stability envelope of the ion trap between 0.710 and 0.891.

13. The method as in claims 6 or 7 in which said supplemental field has a frequency to establish a beta value of ejection on the stability envelope of the ion trap between 0.536 and 0.945.

14. The method of operating an ion trap mass spectrometer in the high resolution mode comprising the steps of defining a trap volume with a three-dimensional substantially quadrupole field for trapping ions within a predetermined range of mass-to-charge ratio, forming or injecting ions within said trap volume such that those within said predetermined mass-to-charge ratio range are trapped, applying a supplementary AC field superimposed on said three-dimensional quadrupole field to form combined fields, scanning said combined fields to resonantly eject ions of consecutive mass-to-charge ratio from said trap volume for detection characterized in that said supplementary field has a frequency to establish a beta value on the stability envelope of the ion trap below 0.891 and said combined fields are scanned at a rate so that a length of time corresponding to 200 cycles or more of the supplementary AC field occurs per consecutive thomson.

* * * * *